US011576505B2

(12) United States Patent
Hansen

(10) Patent No.: US 11,576,505 B2
(45) Date of Patent: Feb. 14, 2023

(54) FOOD STATION WITH REPOSITIONABLE SHIELD

(71) Applicant: The Vollrath Company, LLC, Sheboygan, WI (US)

(72) Inventor: Brandon M. Hansen, Hastings, MN (US)

(73) Assignee: The Vollrath Company, LLC, Sheboygan, WI (US)

( * ) Notice: Subject to any disclaimer, the term of this patent is extended or adjusted under 35 U.S.C. 154(b) by 95 days.

(21) Appl. No.: 16/781,886

(22) Filed: Feb. 4, 2020

(65) Prior Publication Data

US 2020/0245789 A1 Aug. 6, 2020

Related U.S. Application Data

(60) Provisional application No. 62/802,115, filed on Feb. 6, 2019.

(51) Int. Cl.
*A47F 10/06* (2006.01)
*E05D 11/06* (2006.01)

(52) U.S. Cl.
CPC ..... *A47F 10/06* (2013.01); *E05D 11/06* (2013.01); *A47F 2010/065* (2013.01); *E05Y 2900/204* (2013.01)

(58) Field of Classification Search
CPC .... A47F 10/06; A47F 2010/065; A47F 3/007; A47F 3/005; A47F 3/0434;
(Continued)

(56) References Cited

U.S. PATENT DOCUMENTS 443,350 A 12/1890 Barners
827,950 A * 8/1906 Zimmer ..... F16C 11/04 403/116
(Continued)

FOREIGN PATENT DOCUMENTS

CA 2153439 1/1996
CN 204704255 10/2015
(Continued)

OTHER PUBLICATIONS

BSI Designs: Food Guards, http://www.bsidesigns.com/products/food-guards, viewed Jun. 14, 2018, 2 pgs.
(Continued)

*Primary Examiner* — Hiwot E Tefera
(74) *Attorney, Agent, or Firm* — Foley & Lardner LLP

(57) ABSTRACT

A protective enclosure for a food protection system includes a first hinge member, a second hinge member rotatably coupled to the first hinge member, and a coupler selectively repositionable relative to the first hinge member between an engaged position and a disengaged position. In the engaged position, the coupler engages the first hinge member to limit rotation of the coupler relative to the first hinge member. In the disengaged position, the coupler is free to rotate relative to the first hinge member. The coupler is rotatably coupled to the second hinge member such that (a) rotation of the coupler relative to the second hinge member in a first rotational direction is limited and (b) the coupler is free to rotate relative to the second hinge member in a second rotational direction opposite the first rotational direction.

19 Claims, 21 Drawing Sheets

(58) Field of Classification Search
CPC ..... A47F 2003/008; E05D 11/06; E05D 2011/1035; E05D 11/1028; E05D 11/1078; E05D 2011/1092; E05Y 2900/204; E05Y 2600/12; E05Y 2900/202; Y10T 403/32549; Y10T 403/32557; Y10T 403/32591; Y10T 403/7026; Y10T 403/7031
USPC ..... 16/321, 328, 329, 331, 332
See application file for complete search history.

(56) References Cited

U.S. PATENT DOCUMENTS 1,023,789 A 4/1912 Miller
1,075,334 A 10/1913 Cobb
1,288,665 A 12/1918 Page
1,358,262 A * 11/1920 Sumner ..... B60J 3/002 296/95.1
1,431,371 A 10/1922 Chapman
1,644,675 A 12/1925 Huening
1,705,237 A 3/1929 Bulman
1,725,867 A 8/1929 Kennedy
2,767,003 A * 10/1956 Gilmont ..... B01L 9/50 403/385
3,554,416 A 1/1971 Bott
3,561,713 A 2/1971 Berkowitz
3,795,379 A 3/1974 Gray
3,921,539 A 11/1975 Berger
4,216,844 A * 8/1980 Klafs ..... E05D 11/1007 16/329
4,230,414 A 10/1980 Cheshire
4,448,337 A 5/1984 Cronce
4,469,261 A 9/1984 Stapleton et al.
4,500,020 A 2/1985 Rasor
4,506,408 A 3/1985 Brown
4,608,773 A 9/1986 White
4,658,983 A 4/1987 Suttles
4,660,885 A 4/1987 Suhr et al.
4,662,114 A 5/1987 Suttles
D293,985 S 2/1988 White
4,757,769 A 7/1988 Suttles
D297,490 S 9/1988 Suttles
4,773,543 A 9/1988 Suttles et al.
D298,596 S 11/1988 Suttles
4,829,611 A 5/1989 Fireman et al.
D301,665 S 6/1989 Suttles
D302,221 S 7/1989 Suttles et al.
4,852,954 A 8/1989 Brown et al.
D303,190 S 9/1989 Suttles
D304,535 S 11/1989 White
4,881,660 A 11/1989 Suttles
4,909,491 A 3/1990 Cheng
4,915,334 A 4/1990 White
D309,540 S 7/1990 Suttles et al.
D311,837 S 11/1990 Suttles
D314,876 S 2/1991 Suttles
D324,737 S 3/1992 Stafford
D337,462 S 7/1993 Lavaute et al.
5,664,268 A 9/1997 Stoler et al.
5,699,614 A 12/1997 Garneau, Sr.
5,749,480 A 5/1998 Wood
6,115,921 A 9/2000 Garneau, Sr.
6,132,018 A 10/2000 McGrath
6,267,111 B1 7/2001 Burton
6,290,025 B1 9/2001 Lynn et al.
6,343,406 B1 * 2/2002 Yeh ..... E05D 11/1007 16/328
6,390,424 B1 5/2002 Kidushim et al.
6,421,921 B1 7/2002 Garneau, Sr.
6,485,118 B2 11/2002 Matus, Jr.
D472,083 S 3/2003 English et al.
6,588,863 B1 7/2003 Yatchak et al.
6,612,124 B1 9/2003 Hatch et al.
D497,739 S 11/2004 English et al.
7,040,723 B2 5/2006 Matus, Jr.
7,067,773 B2 6/2006 DeWitt
7,210,742 B2 5/2007 Wu
D543,780 S 6/2007 Myers et al.
D575,560 S 8/2008 English
7,631,575 B2 * 12/2009 Gard ..... F16C 11/10 74/530
7,640,696 B2 1/2010 Yingst
7,784,398 B2 8/2010 Matus, Jr.
7,895,953 B2 3/2011 Matus, Jr.
7,958,673 B2 6/2011 Yingst et al.
D649,865 S 12/2011 English et al.
8,109,579 B2 2/2012 English et al.
8,112,920 B2 2/2012 Fenton
8,128,306 B2 3/2012 Gorza
8,302,919 B1 11/2012 McGrath
8,308,249 B2 11/2012 Matus, Jr.
8,403,430 B2 3/2013 Atkins
8,544,112 B2 10/2013 Gosine
8,585,160 B2 11/2013 Atkins
8,671,618 B2 3/2014 Yingst et al.
8,701,323 B2 4/2014 Fenton
8,898,862 B1 * 12/2014 McGrath ..... E05D 11/1007 16/334
8,925,153 B1 * 1/2015 McGrath ..... E05D 11/1007 16/334
8,925,172 B2 1/2015 English
8,973,876 B1 3/2015 McGrath
9,010,883 B2 4/2015 Scott
9,062,483 B1 6/2015 McGrath
9,144,329 B1 9/2015 McGrath
9,153,147 B2 10/2015 Fenton
9,161,639 B1 10/2015 Hundley et al.
9,249,827 B2 2/2016 Serocki et al.
9,291,188 B2 3/2016 English
D756,759 S 5/2016 Atkins et al.
9,326,621 B1 5/2016 McAllister et al.
9,339,131 B1 5/2016 Christianson
9,399,882 B1 * 7/2016 McGrath ..... E05D 11/1007
9,516,958 B1 12/2016 McAllister et al.
9,538,868 B1 1/2017 Christianson
9,557,004 B1 1/2017 McGrath
9,723,935 B1 8/2017 McAllister et al.
9,777,521 B2 10/2017 Edavana et al.
9,782,022 B2 10/2017 Atkins et al.
9,839,306 B2 12/2017 Atkins et al.
10,024,090 B2 7/2018 Tazbaz et al.
10,047,789 B1 * 8/2018 Mosby ..... F16C 11/10
10,058,198 B2 8/2018 Atkins et al.
10,058,199 B1 8/2018 Perry
10,100,571 B2 10/2018 Deman
10,102,780 B2 10/2018 Fenton
10,159,363 B1 12/2018 McAllister et al.
10,174,534 B2 1/2019 Tazbaz et al.
10,180,022 B1 1/2019 Garg et al.
10,223,985 B2 3/2019 Staton et al.
10,292,506 B2 5/2019 Matus, Jr.
10,405,677 B2 9/2019 Cummings et al.
10,413,097 B2 9/2019 Matus, Jr.
10,415,285 B1 * 9/2019 Anderson ..... A47F 10/06
10,546,517 B2 1/2020 Fenton
10,750,887 B2 8/2020 Atkins et al.
10,765,236 B2 9/2020 Quinter et al.
10,767,405 B1 9/2020 Anderson et al.
10,799,043 B2 * 10/2020 Quinter ..... A47F 10/06
10,818,250 B2 10/2020 Staton et al.
10,986,943 B2 4/2021 Quinter
11,129,484 B2 9/2021 Scott
2002/0096976 A1 7/2002 Matus
2003/0047086 A1 3/2003 Matus, Jr.
2003/0057810 A1 3/2003 DeWitt
2004/0226903 A1 11/2004 Wang
2005/0061585 A1 3/2005 Yingst
2006/0163976 A1 7/2006 Matus, Jr.
2006/0175940 A1 8/2006 English
2006/0192467 A1 8/2006 Matus, Jr.
2007/0236112 A1 10/2007 Williman
2009/0224583 A1 * 9/2009 Nagura ..... B60N 2/236 297/302.6
2010/0045149 A1 2/2010 English et al.

(56) References Cited

U.S. PATENT DOCUMENTS

| | | | | |
|---|---|---|---|---|
| 2011/0080075 | A1 | 4/2011 | Matus, Jr. | |
| 2011/0169384 | A1 | 7/2011 | Padden et al. | |
| 2012/0200207 | A1* | 8/2012 | Atkins | A47F 10/06 312/137 |
| 2014/0366751 | A1 | 12/2014 | Atkins et al. | |
| 2015/0289641 | A1 | 10/2015 | Ergun et al. | |
| 2016/0073795 | A1 | 3/2016 | Matus, Jr. | |
| 2016/0331155 | A1 | 11/2016 | Atkins et al. | |
| 2018/0242760 | A1* | 8/2018 | Cummings | A47F 3/007 |
| 2019/0110588 | A1 | 4/2019 | Wong | |
| 2019/0110613 | A1 | 4/2019 | Charlier et al. | |
| 2019/0110614 | A1* | 4/2019 | Charlier | A47F 10/06 |
| 2019/0128034 | A1 | 5/2019 | Luedtke | |
| 2019/0150640 | A1* | 5/2019 | Scott | E05D 11/1078 |
| 2019/0350386 | A1 | 11/2019 | Cummings et al. | |
| 2020/0046146 | A1 | 2/2020 | Hansen | |

FOREIGN PATENT DOCUMENTS

| | | | |
|---|---|---|---|
| DE | 10320528.2 | | 12/2004 |
| DE | 10320528 | A1 | 12/2004 |
| FR | 2504216 | B3 | 2/1984 |
| JP | 2007-159882 | A | 6/2007 |
| JP | 2011-012750 | A | 1/2011 |

OTHER PUBLICATIONS

BSI: Deco Engineered Food Shields, Model: DECO-250-N, Apr. 30, 2017 (Apr. 30, 2017), XP055544067, Retrieved from the Internet: URL:https://assetcloud.roccommerce.net//files/_singer/4/10/8/10004447_spec_sheet.pdf.

International Search Report and Written Opinion of the International Searching Authority for PCT/US2018/000384 dated Jan. 28, 2019.

Mark Johnsn, Workshop, Finer Futon Frame, Not just for dorm rooms anymore, Handy, Mar./Apr. 2002, viewed Dec. 9, 2014, pp. 10 and 12-16.

PMG Premier Metal & Glass, Self Serve Sneeze Guards, https://www.pmg-inc./self-serve-sneeze-guards, viewed Jun. 14, 2018, 1 pg.

Stepless adjustment for angular position 2, https://www.youtube.com/watch?v=-ip9PIJ7z5Q uploaded on Jun. 19, 2019, 23 pages.

Versa Gard, Food Protection System, Sneeze Guards, http://versagard.com, viewed Jun. 14, 2018, 1 pg.

Woodsmith Plans, Designer Series Project, Craftsman-style Futon Sofa Bed, WoodsmithPlans.com (WS15226), Aug. 2012 Home Publishing Co., pp. 1-8.

* cited by examiner

FOOD STATION WITH REPOSITIONABLE SHIELD

CROSS-REFERENCE TO RELATED PATENT APPLICATION

This application claims the benefit of U.S. Provisional Patent Application No. 62/802,115, filed Feb. 6, 2019, which is incorporated herein by reference in its entirety.

BACKGROUND

The present disclosure relates generally to food and/or beverage stations used in the food service industry, such as to serve food and beverage items on a self-serve basis to patrons. Such food stations may include protective enclosures around the food and beverage items to help provide protection against airborne contamination. More specifically, the present disclosure relates to such food stations and protective enclosures in which the protective enclosure has a repositionable shield.

The food service industry uses food stations to present and serve food and beverage items. Multiple food stations often are used in combination in situations such as self-serve buffets, restaurant dining rooms, cafeteria-style serving facilities, catered events, and the like. A typical food station includes a base cabinet that may be on casters or other similar hardware to allow the station to be more easily moved to different locations or positions. The base cabinet is fitted with a countertop on which food and/or beverages as well as related meal utensils may be presented for consumption or use by patrons. Some food stations have one or more wells that hold pans of food. Eating utensils, and other meal related items also may be presented on a food station. Food stations also may include cooling or heating components to serve cold or hot food or beverages. To power heating and cooling components, food stations may include power supplies or components that allow the food station to be connected to power supplies. Some stations may include plumbing components to couple the station to a water supply and/or to drains.

Food stations may be set up for self-serve functionality in which a patron selects and serves his or her own food or beverages from the station. Self-serve stations may be single-sided so that patrons accomplish self-service from only one side of the station. Other food stations are configured to allow self-service from two or more sides of the station. Other food stations, such as those in cafeterias, allow the patrons to view and select food or beverage items, but it is service personnel who then serve the selections.

According to applicable food service regulations in many venues, a protective enclosure often is mounted over the countertop and food/beverage supplies of a food station to protect against airborne contamination. These protective enclosures are also known in the food service industry as sneeze guards or breathe guards. A typical protective enclosure used on self-serve food stations includes a top panel, and one or more side panels. Side panels often are included on the ends of the food station as well as on the side(s) on which patrons interact with the food station. The sides used by food service personnel optionally may include a side panel, but often do not. As used herein, a side panel that is deployed on the side(s) of a food station accessible to patrons will be referred to as a front panel or shield.

A typical front panel is transparent so that the items presented on the station can be easily viewed through the panel. For self-serve situations (e.g., in a self-serve mode of operation), the front panel or shield is deployed in a raised configuration so that it protects the food supply while still permitting the patron to reach under the panel to access the food supply. If a station permits self-serve access from two or more sides of the station, each such side is configured with a similar, raised shield panel. In contrast to self-serve situations, a typical front panel used on some foods stations (e.g., in a served mode of operation) is fully lowered so that patrons can view and select food choices, but the patrons are served by other personnel and cannot directly access food products for self-service.

It would be desirable if a protective enclosure allows one or more of the side panels of a protective enclosure, including but not limited to the front panels, to be easily raised and lowered to work in both self-service and cafeteria-style applications. It would also be desirable if the moveable side panel(s) could be set in multiple fixed positions as desired. For example, a configuration may be desired in which a side panel would be lowered to block access to the food station from that side. This can be done to close the station or to convert the station from a self-serve mode to a served mode. Another configuration may also be desired in which that same side panel could be raised and fixed in one or more raised positions to allow self-serve access by patrons or access by food service personnel for maintenance, upkeep, or service.

SUMMARY

At least one embodiment relates to a protective enclosure for a food protection system. The enclosure includes a first hinge member coupled to one of a frame and a shield, a second hinge member coupled to the other of the frame and the shield and rotatably coupled to the first hinge member, and a coupler selectively repositionable relative to the first hinge member between an engaged position and a disengaged position. In the engaged position, the coupler engages the first hinge member to limit rotation of the coupler relative to the first hinge member. In the disengaged position, the coupler is free to rotate relative to the first hinge member. The coupler is rotatably coupled to the second hinge member such that (a) rotation of the coupler relative to the second hinge member in a first rotational direction is limited and (b) the coupler is free to rotate relative to the second hinge member in a second rotational direction opposite the first rotational direction.

Another embodiment relates to a food protection system including a food station configured to contain at least one of food products or beverages for serving, a shield panel configured to obstruct access to the at least one of food products or beverages, a frame coupled to the food station and supporting the shield panel, and a first hinge assembly and a second hinge assembly each pivotally coupling the shield panel to the frame. The first hinge assembly includes a first hinge member coupled to one of the frame and the shield panel, the first hinge member including a first spline feature, a second hinge member coupled to the other of the frame and the shield panel and rotatably coupled to the first hinge member about an axis, and a coupler including a second spline feature. The coupler is selectively repositionable along the axis between (a) a first position in which the first spline feature engages the second spline feature to prevent rotation of the coupler relative to the first hinge member about the axis and (b) a second position in which the first spline feature is disengaged from the second spline feature and the coupler is free to rotate relative to the first hinge member about the axis in at least one rotational direction.

Another embodiment relates to a food protection system including a food station configured to contain at least one of food products or beverages for serving, a shield panel configured to obstruct access to the at least one of food products or beverages, a frame coupled to the food station and supporting the shield panel, and a hinge assembly coupling the shield panel to the frame such that the shield panel is configured to be selectively raised relative to the food station. The hinge assembly includes a first hinge member coupled to one of the frame and the shield panel, a second hinge member coupled to the other of the frame and the shield panel, a coupling ring coupled to the first hinge member and defining an aperture, a post coupled to the second hinge member, extending along a post axis, and received by the aperture of the coupling ring, and a plurality of clutch members extending between the post and the coupling ring. The coupling ring is free to rotate relative to the post about the post axis in a first rotational direction corresponding to raising the shield panel. The clutch members are configured to engage the post and the coupling ring to inhibit rotation of the coupling ring relative to the post in a second rotational direction corresponding to lowering the shield panel.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 2:
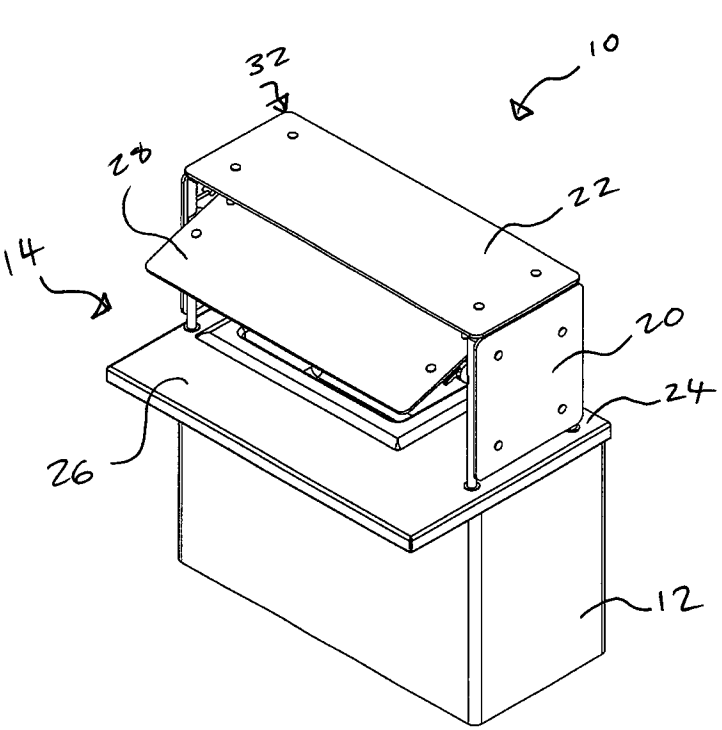
FIG. 2 is a front perspective view of the food station of FIG. 1 with the shield panel in an open position.
Figure 1:
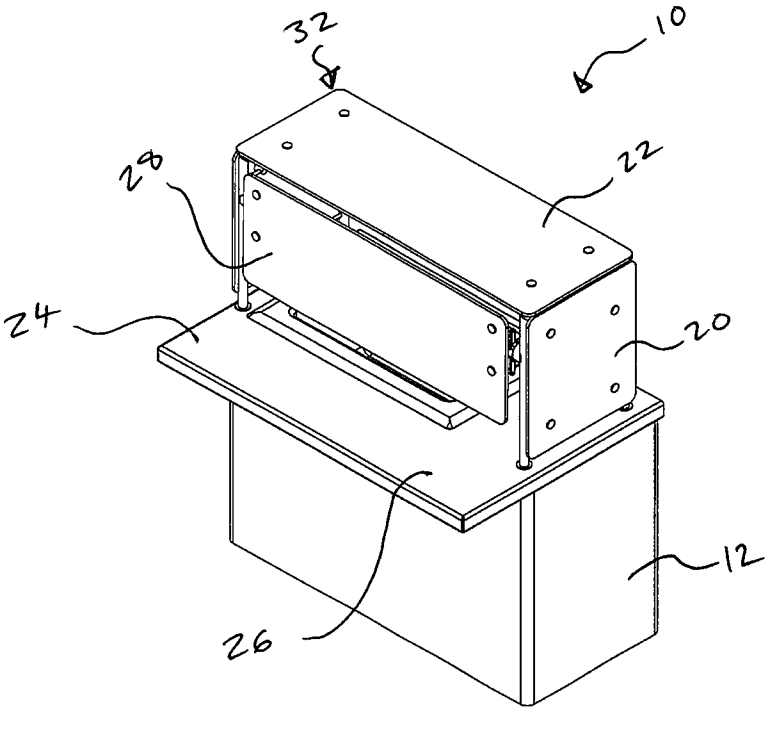
FIG. 1 is a front perspective view of a food station having a protective enclosure to guard a food supply, the protective enclosure including a selectively repositionable shield panel in a closed position.
Figure 4:
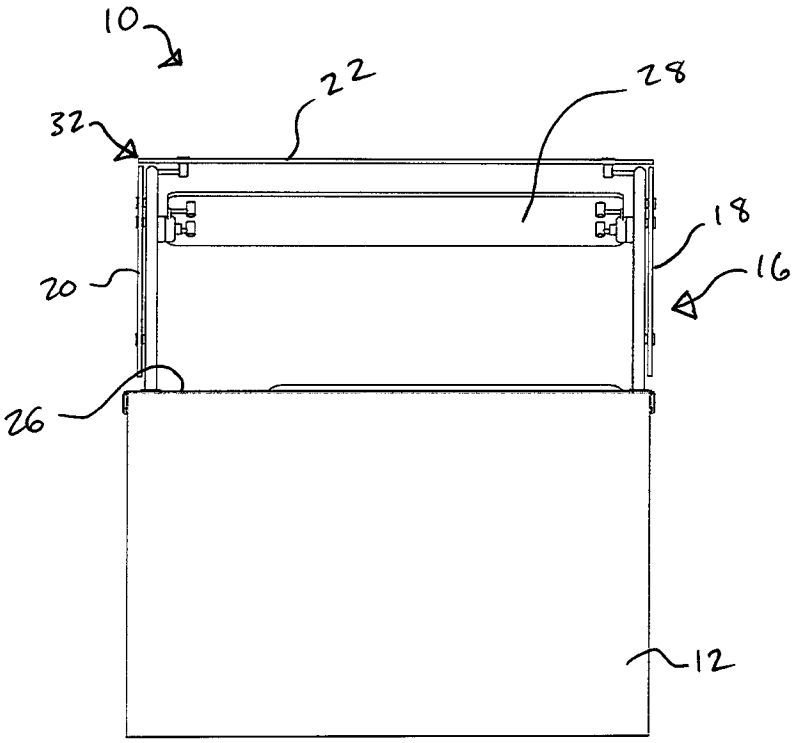
FIG. 4 is a rear view of the food station of FIG. 1.
Figure 3:
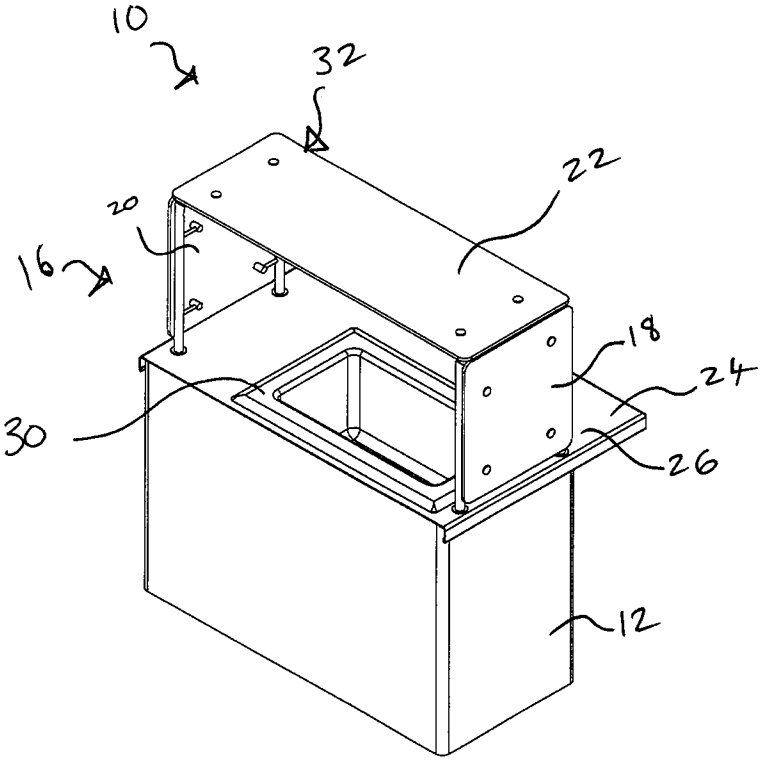
FIG. 3 is a rear perspective view of the food station of FIG. 1.
Figure 6:
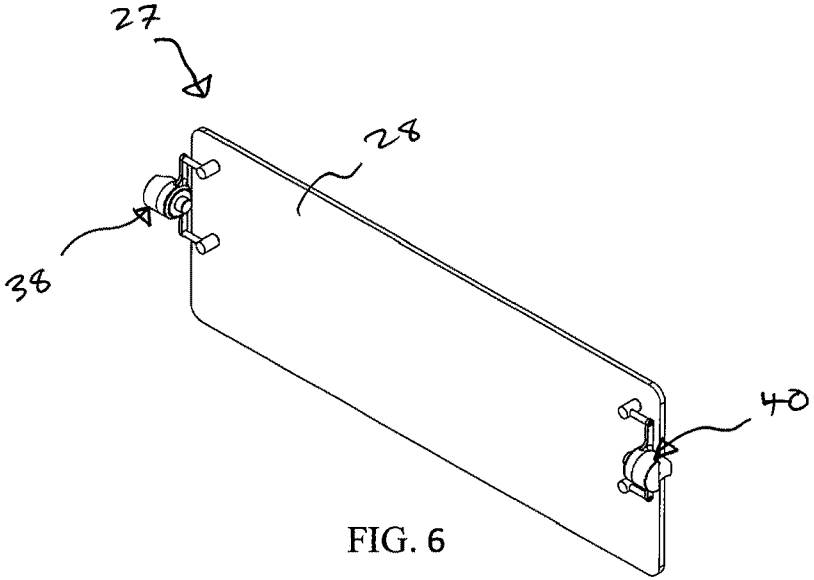
FIG. 6 is a rear perspective view of the selectively repositionable shield and hinge assemblies shown in FIG. 5.
Figure 7:
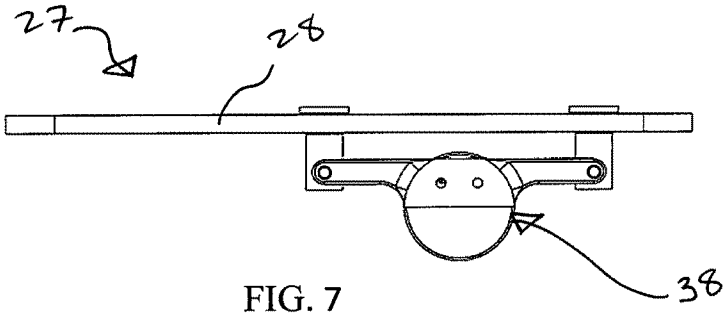
FIG. 7 is a side view of the selectively repositionable shield and hinge assemblies shown in FIG. 5.
Figure 5:
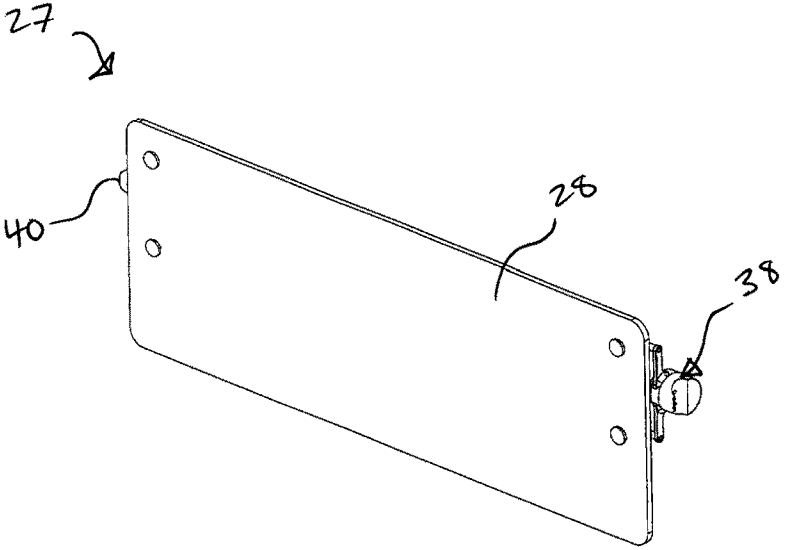
FIG. 5 is a front perspective view of a portion of the protective enclosure of FIG. 1 showing the selectively repositionable shield coupled to a coupling system, the coupling system including a pair of hinge assemblies that facilitate repositioning the shield panel.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting. The embodiments described below are not intended to be exhaustive or to be limited to the precise forms disclosed in the following detailed description. Rather a purpose of the embodiments chosen and described is so that the appreciation and understanding by others skilled in the art of the principles and practices of the present invention can be facilitated.

The systems disclosed herein may be similar to the systems disclosed in U.S. patent application Ser. No. 16/533,306, filed Aug. 6, 2019, the entire disclosure of which is incorporated herein by reference. U.S. patent application Ser. No. 16/533,306 claims the benefit of priority to U.S. Provisional Patent Application No. 62/717,114, filed Aug. 10, 2018, the entire disclosure of which is incorporated herein by reference.

The present disclosure provides protective enclosures and food and/or beverage stations with these enclosures in which one or more side panels are easily raised and lowered and easily fixed in one or more positions as desired. For example, side panels, such as shield panels, can be easily lowered or closed or easily raised and fixed in one or more open configurations. The present disclosure describes a coupling system that pivotably couples the moveable and selectively repositionable side panels to the rest of the protective enclosure. The coupling system uses a system of selectively rotational components and connections that cooperatively guide, help fix, and/or limit or restrict the movement and positioning of the side panel in its range of motion.

The present disclosure describes a rotatable hinge used to couple a moveable shield or panel directly or indirectly (e.g., through one or more intervening components) to a support structure. The hinge incorporates features to help control rotation in panel raising or panel lowering rotational direction. In one configuration, the features permit the hinge to rotate so the panel can be raised while preventing hinge rotation in the other, or lowering rotational direction. Thus, the panel can be raised to a desired position. The hinge has a second configuration that allows the rotation in the lowering rotational direction. The lowering configuration can be accessed on demand. Additional features of the hinge assembly help to control lowering to avoid freefall release of the panel. In some embodiments, the hinge is biased to permit rotation to release the panel. A simple press of a button permits a lowering rotation. The hinge can include various features that limit, control, or define a range of motion of the panel in order to limit movement to usable or desirable positions and ranges.

The selectively rotational components and connections permit the side panel to be raised or lowered on demand by a user and fixed into one or more fixed positions. Continuous or incremental fixed position intervals can be used. By way of example, the side panel can be raised in increments of about 1°-20°, preferably of increments of 5°-15°, and even more preferably increments of about 10°-15°. This makes the side panel easy to move and deploy according to desired angles and positions. For example, when a side panel is opened and raised from a lowered position, the side panel may selectively remain in certain fixed positions at set intervals or continuously such that when the side panel is not further raised, it substantially stays in place, predictably and stably. The panel will not fall, as the hinge prevents lowering rotation. In the meantime, the panel can be easily raised to more open positions, as the hinge permits this rotation without requiring engagement of another control, such as a button. Optional locking mechanisms may be used, if desired, so the panel is locked into fixed position if desired. If it is instead desired to lower the side panel, the hinge can be actuated to release the side panel for lowering. Lowering may also occur in increments, as desired.

Referring generally to the figures, a food (and/or beverage) station 10 (e.g., a buffet station or food table) is shown according to various exemplary embodiments. In practice, even though a single food station 10 is shown in the figures, multiple units of the food station 10 may be deployed in one or more rows or sections in order to present a more complete buffet selection of food items to patrons. Food station 10 is of the type that allows self-serve patron access to one or more food supplies held in food station 10. For purposes of illustration, food station 10 is a single-sided embodiment in the sense that a self-serve patron can access the food station 10 from a front side 14. Access to the food supply from a rear side 16 may be blocked and/or limited only to designated service personnel such as to serve, clean, service, or maintain the food station 10 or its food supply(ies). Other embodiments of food station 10 may be configured so that patrons may access one or more food supplies from either the front and/or rear sides 14 and 16 and/or even from one or both ends 18 and/or 20 of food station 10.

Referring now mainly to FIGS. 1-9, the food station 10 includes a base in the form of enclosed base cabinet 12 which optionally may be used for a variety of purposes such as to store food station supplies and/or to house functional food station components such as drains or other plumbing, refrigeration components, lighting, heating, sensors such as temperature sensors or food or beverage level sensors, electrical power components, and the like. Optionally, base cabinet 12 may be fitted with casters or other mobility devices to allow food station 10 to be more easily moved to different locations or positions. Such mobility devices may be lockable to prevent mobility once food station 10 is located or positioned in a desired manner.

As shown, food station 10 includes countertop 24 mounted onto base cabinet 12. Countertop 24 includes upper surface 26 and one or more wells holding food supplies in corresponding pan(s) 30. For purposes of illustration, countertop 24 is configured with a single pan 30. Such an embodiment further provides additional room on upper surface 26 to store some items, such as some food items, serving tools, eating utensils, food toppings, or the like that do not need to be deployed in pans. Other embodiments may include two or more pans 30 or other serving containers and corresponding food supplies. For example, such other embodiments may include, from 2 to 8 sets of pans 30 and their food supplies held in corresponding countertop wells.

Food station 10 includes a food protection system in the form of protective enclosure 32 that helps to protect food supply pan 30 from contamination, particularly airborne contamination. In the food service industry, protective enclosure 32 also is known as a "breath guard," "food guard," or "sneeze guard" system.

Many components of the food station 10 can be fastenable to the support structure 33 using one or more suitable attachment techniques such as welding, brazing, gluing, bolting, threaded engagement, riveting, snap-fit engagement, and/or the like. Standoffs can be included and mounted onto the ends of pins and provide attachment sites for top panel 22. Any suitable attachment technique may be used. For example, mounting hardware such as bolts, rivets, or machine screws and associated washers may be used to attach top panel 22 to the support structure 33. Top panel 22 can include corresponding mounting apertures to accommodate such fasteners.

Accessories for food station 10, such as heaters, lights, fans, filters, and the like may be mounted onto protective enclosure 32 as an option. For example, a heater can be attached to an underside of top panel 22 to help keep food supply pan 30 warm.

Figure 11:
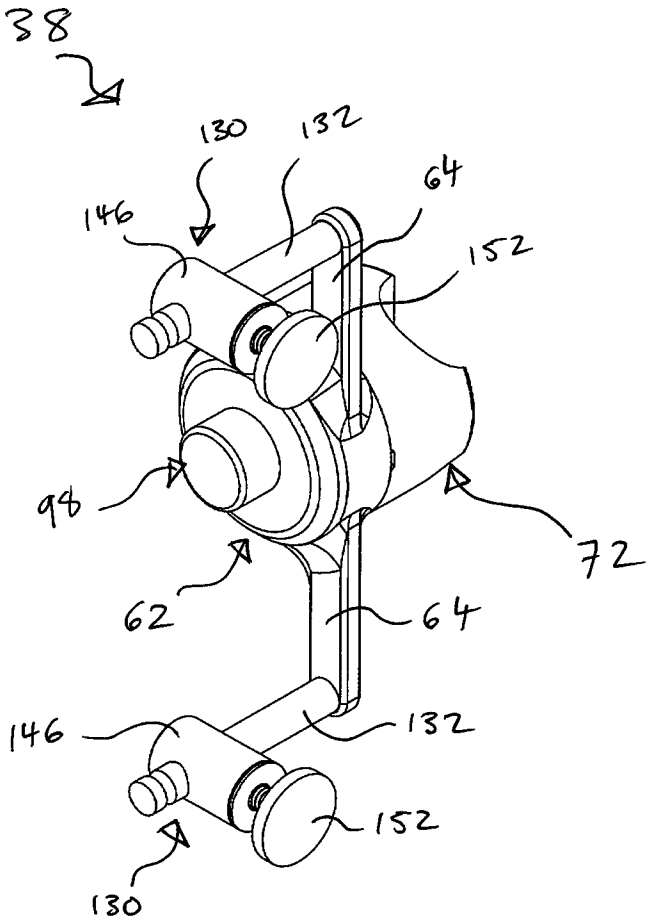
FIG. 11 is a rear perspective view of a hinge assembly of FIG. 7.
Figure 10:
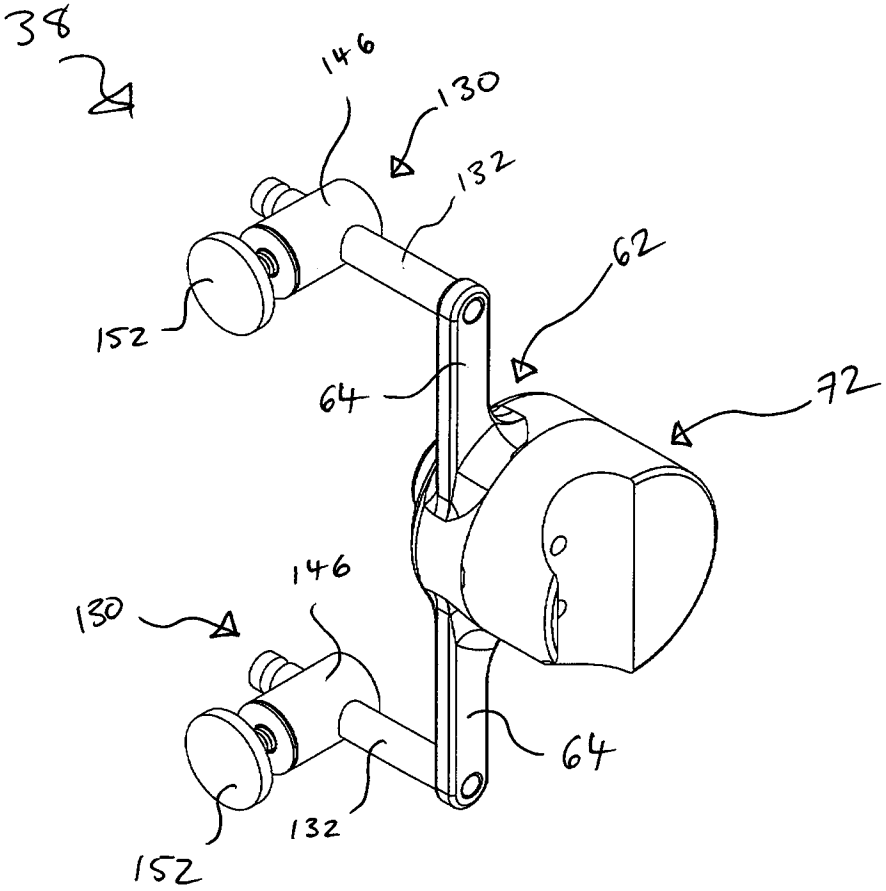
FIG. 10 is a front perspective view of a hinge assembly of FIG. 7.

As main components, protective enclosure 32 includes a frame, frame structure, or support structure 33, a top panel 22, and side panels including end panels 18/20, and a moveable and positionable shield (or shield panel, herein) 28, one or more hinge assemblies 38/40 that operate to selectively and pivotably couple shield 28 directly or indirectly (e.g., through one or more intervening components) to the support structure 33 of the protective enclosure 32, and one or more coupling devices 130 (i.e., shield coupling assemblies) (e.g., shown in FIGS. 10 and 11) that operate to securely connect the shield 28 to the one or more hinge assemblies 38/40.

As shown in FIGS. 1, 2, and 5-9, an adjustable breath guard arrangement for food station 10 is provided and includes a panel, shown as shield 28. The shield 28 may be transparent, substantially rectangular, and/or planar. In other embodiments, the shield 28 can take the form of other different shapes and can include curves and other variations. The shield 28 can be rotatably attached to the support structure 33 of the food station 10. The shield 28 can be opened/rotated to various open position dihedral angles 46 with respect to the upper surface 26, which can be controlled using various components of the first hinge assembly 38.

Figure 8:
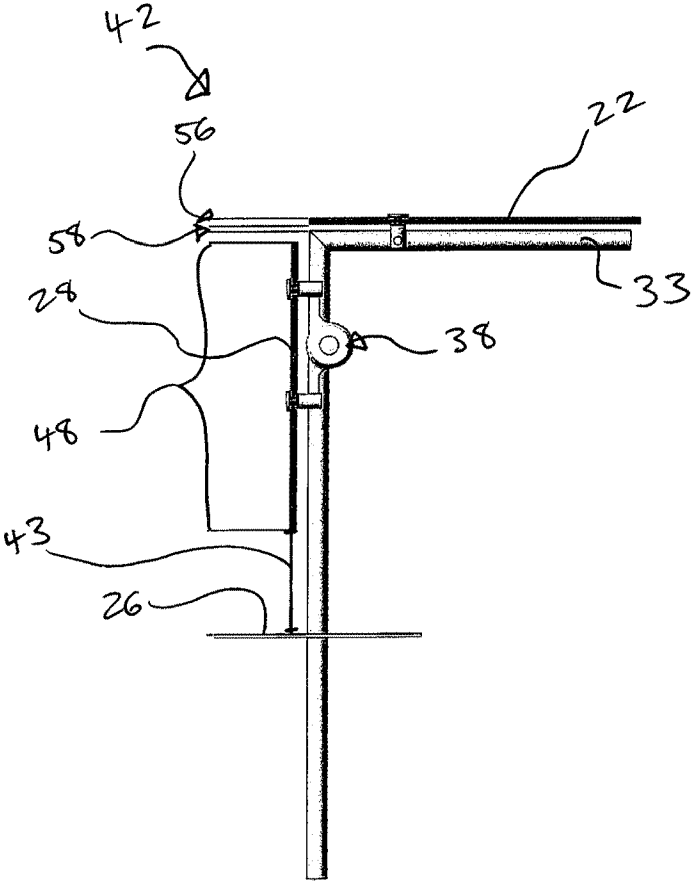
FIG. 8 is a side view of a support structure of the food protection system of FIG. 1, shown in the closed position.

Shield 28 can have a shield thickness 50 (e.g., measured substantially perpendicular to a primary plane of the shield 28) selected to be of a proper weight and strength, as desired. Various top panel 22, end panel 18/20, and shield 28 materials can be selected, including but not limited to glass, Plexiglas, other plastics and transparent materials, and the like. The shield 28 can have various dimensions, including a shield depth shown at 48, which can be sized to substantially block access to food station 10 when the protective enclosure 32 is in the closed position 42 as shown in FIG. 8. However, a closed position 42 vertical clearance 43 may remain below shield 28 and above upper surface 26 in various embodiments.

Figure 9:
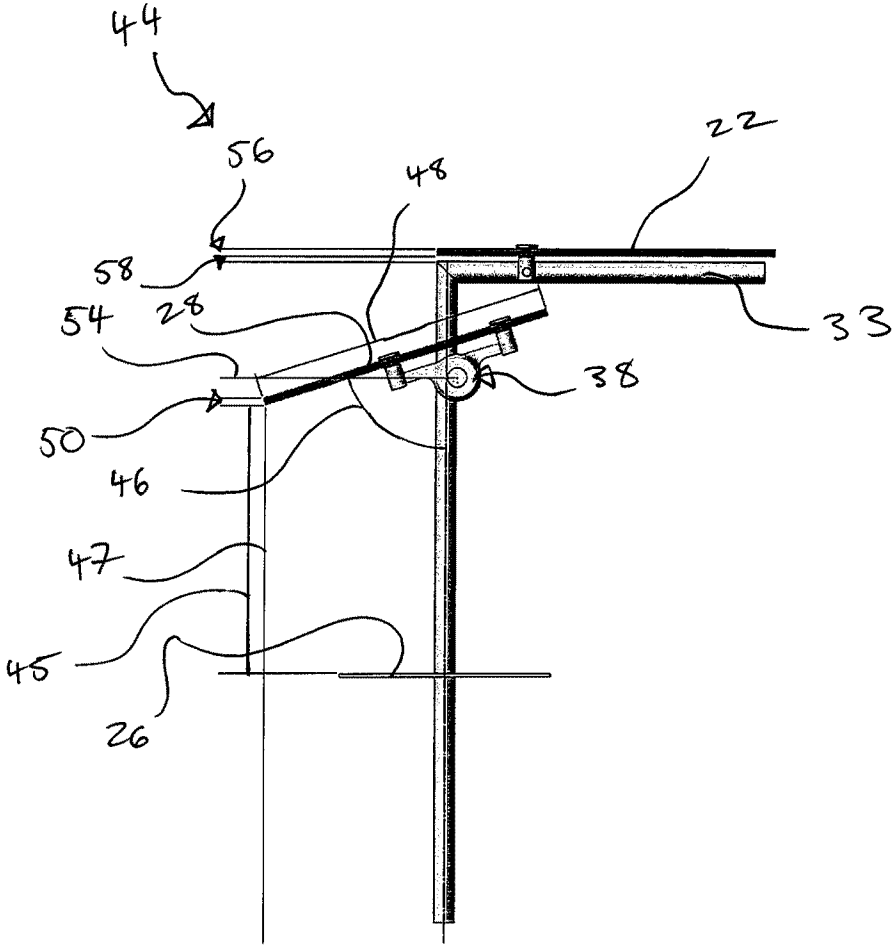
FIG. 9 is a side view of a support structure of the food protection system of FIG. 1, shown in an open position.

When the protective enclosure 32 is in an open position 44 as shown in FIG. 9, a larger, open position vertical clearance 45 between the shield 28 and the upper surface 26 can result. Various components of the food station 10 can be selected such that an open position vertical shield height from ground 47 allows a user to make use of food station 10 conveniently from the front side 14 when in the open position 44.

At least one hinge assembly 38 and/or 40 is used to pivotably couple shield 28 to the support structure 33. Use of hinge assembly 38 and/or 40 allows the rotation, and hence raising and lowering of shield 28, to be controlled on demand. In some embodiments, a pair of such hinge assemblies are used so that complementary rotation control is provided at each end of shield 28. Alternatively, a single hinge assembly 38 or 40 may be used to control rotation on one end of shield 28 while a simpler or different rotational coupling (e.g., a post in a bearing) is used at the other end.

Each hinge assembly 38 or 40 controls (e.g., selectively permits) relative rotation between the substrates coupled to each side of the hinge. For example, FIGS. 1-7 show each of hinges 38/40 connected to the moveable shield 28 as one hinge substrate and the support structure 33 as the other hinge substrate to allow relative rotation between the shield and the support structure 33. Intervening components may be used as substrates where indirect connections are used. For example, a hinge assembly 38/40 can be connected on one side to an end panel 18/20 rather than directly to support structure 33. As another example, the other side of hinge assembly 38/40 can be connected to shield gripping hardware rather than directly to the shield 28.

With reference in particular to FIGS. 10-14, a hinge assembly, such as a first hinge assembly 38, is described. The first hinge assembly 38 generally rotatably and controllably couples the shield 28 to the support structure 33 to control and allow relative rotation movement while still keeping the food station 10 components connected together.

Figure 13:
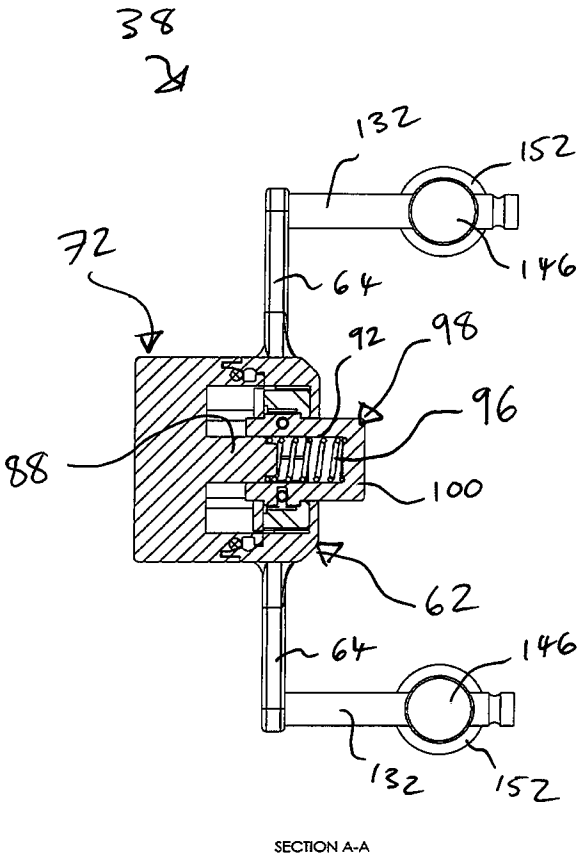
FIG. 13 is a cross-section view of the hinge assembly of FIG. 12.
Figure 12:
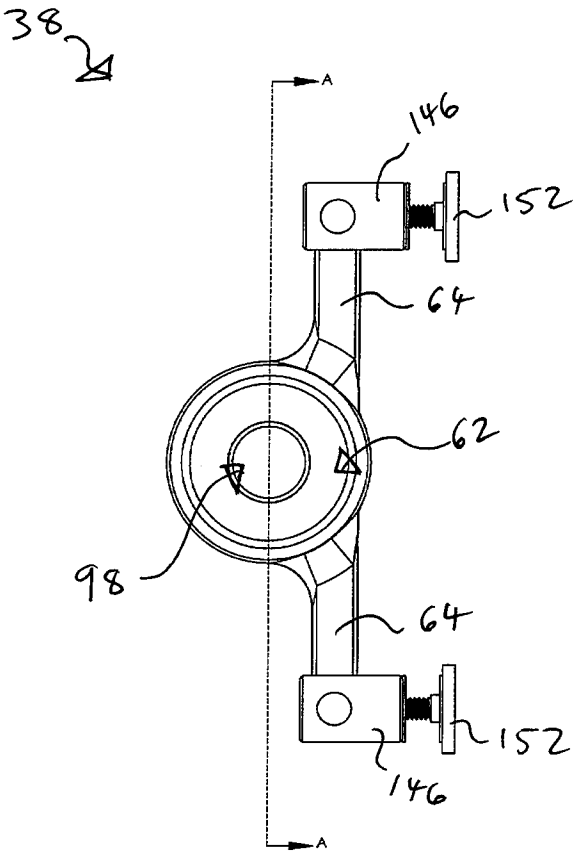
FIG. 12 is a front view of a hinge assembly of FIG. 7.

FIG. 13 is a cross-section view of the first hinge assembly 38 along line A-A as shown in FIG. 12. This cross-section view reveals various components of the first hinge assembly 38, including a first hinge member 62, a second hinge member 72, a main button spring 96 and a button 100, and various components of the button and clutch assembly 98. A coupling member as used herein can include the button and clutch assembly 98 in addition to the inner post 88 of the second hinge member 72. Also shown is a connection at a post between an externally faceted inner post 88 of the second hinge member 72 and an internally and complementary faceted outer post sleeve 92 of the first hinge member 62 button and clutch assembly 98 in slidable connection with the inner post 88, described in greater detail below.

Figure 14:
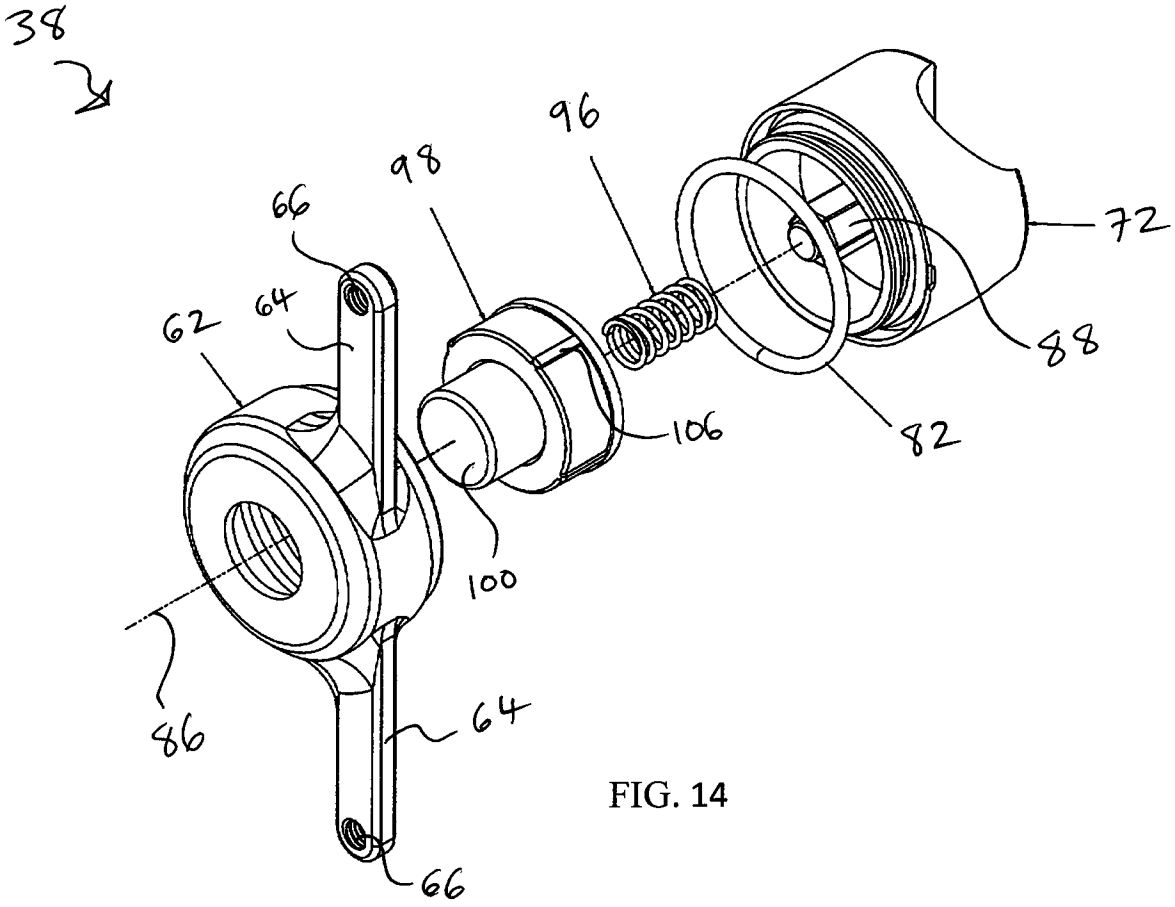
FIG. 14 is an exploded view of the hinge assembly of FIG. 12.
Figure 18:
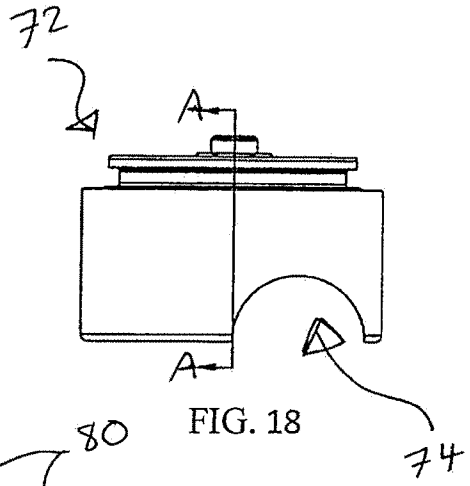
FIG. 18 is a side view of the second hinge member of FIG. 15.

With reference to FIG. 14, an exploded front perspective view of the first hinge assembly 38 is shown. A retaining ring 82 is shown between the first and second hinge members 62, 72 along a circumferential joint. Also shown is the inner post 88 (e.g., extending along a post axis 86) of the second hinge member 72.

It is noted that the components of the second hinge assembly 40 may be substantially similar to the components of the first hinge assembly 38, but may be mirrored, reversed, or otherwise modified in order to facilitate appropriate complementary rotational properties when raising and lowering the shield 28. It should be understood that a second hinge assembly 40 can also be used to operate in cooperation with the first hinge assembly 38 and can also rotatably connect the shield 28 to the support structure 33. The second hinge assembly 40 can be substantially similar to the first hinge assembly 38, but may include mirrored, reversed, or other alterations such that first and second hinge assemblies control raising and lowering of shield 28 in the same manner. For example raising occurs on one as a relative clockwise rotation while occurring on the other as a relative counterclockwise rotation, as desired.

As shown with reference to FIGS. 8 and 9, a hinge height 54 is a height of a center of the first hinge assembly 38 from the applicable ground or floor. Also as shown, top panel 22 can have a top panel thickness 56, and can be spaced from support structure 33 by a top panel gap 58.

Figure 21:
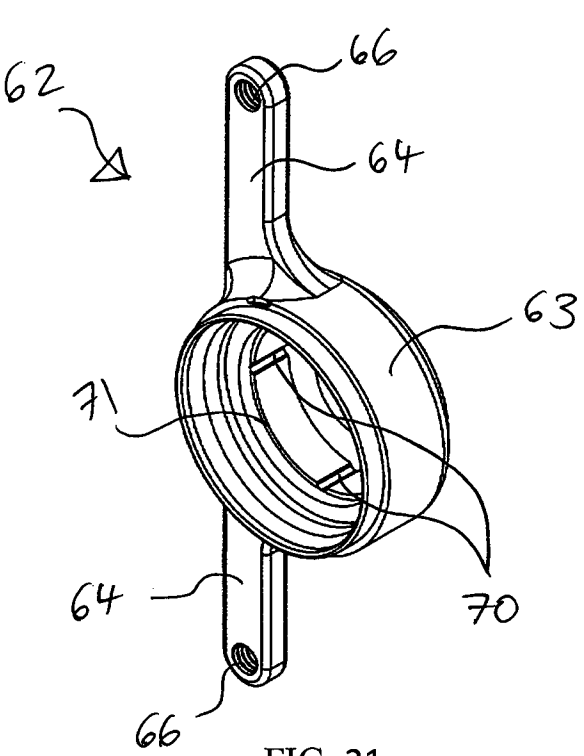
FIG. 21 is a rear perspective view of the first hinge member of FIG. 20.
Figure 20:
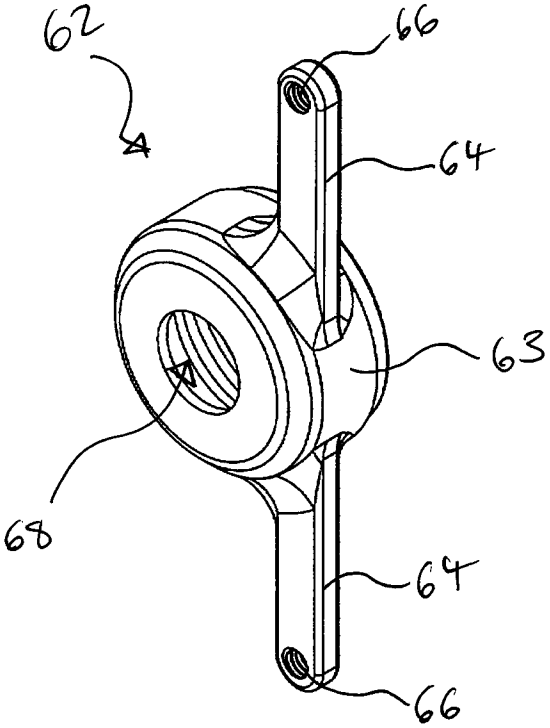
FIG. 20 is a front perspective view of a first hinge member of FIG. 14.
Figure 23:
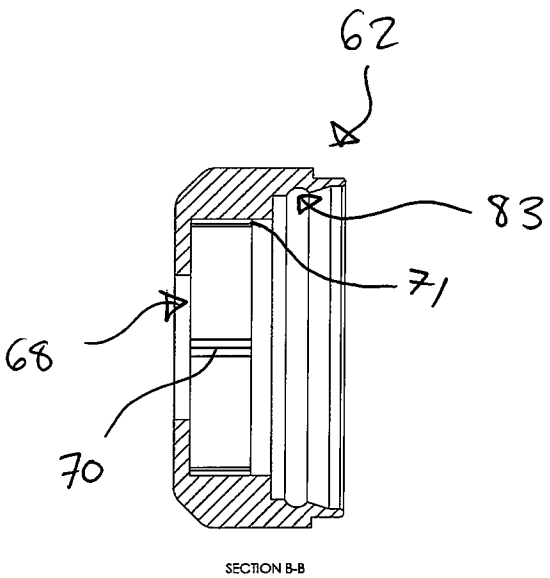
FIG. 23 is a cross-section view of the first hinge member of FIG. 22.
Figure 22:
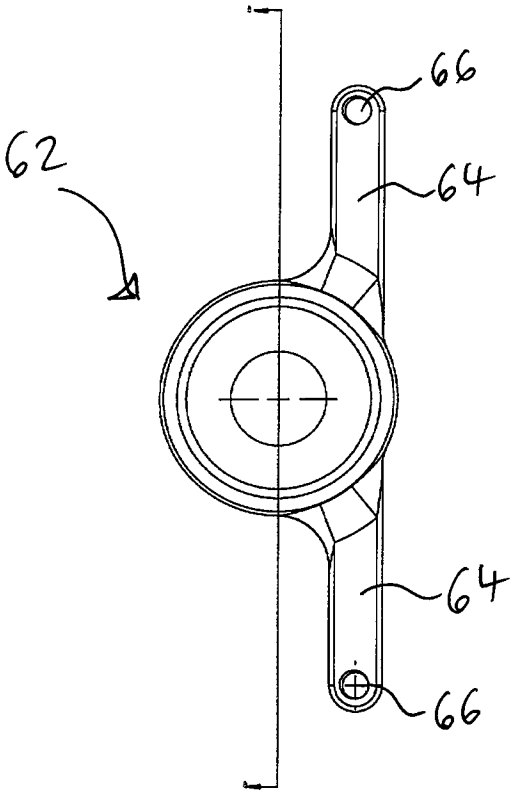
FIG. 22 is a front view of the first hinge member of FIG. 20.
Figure 25:
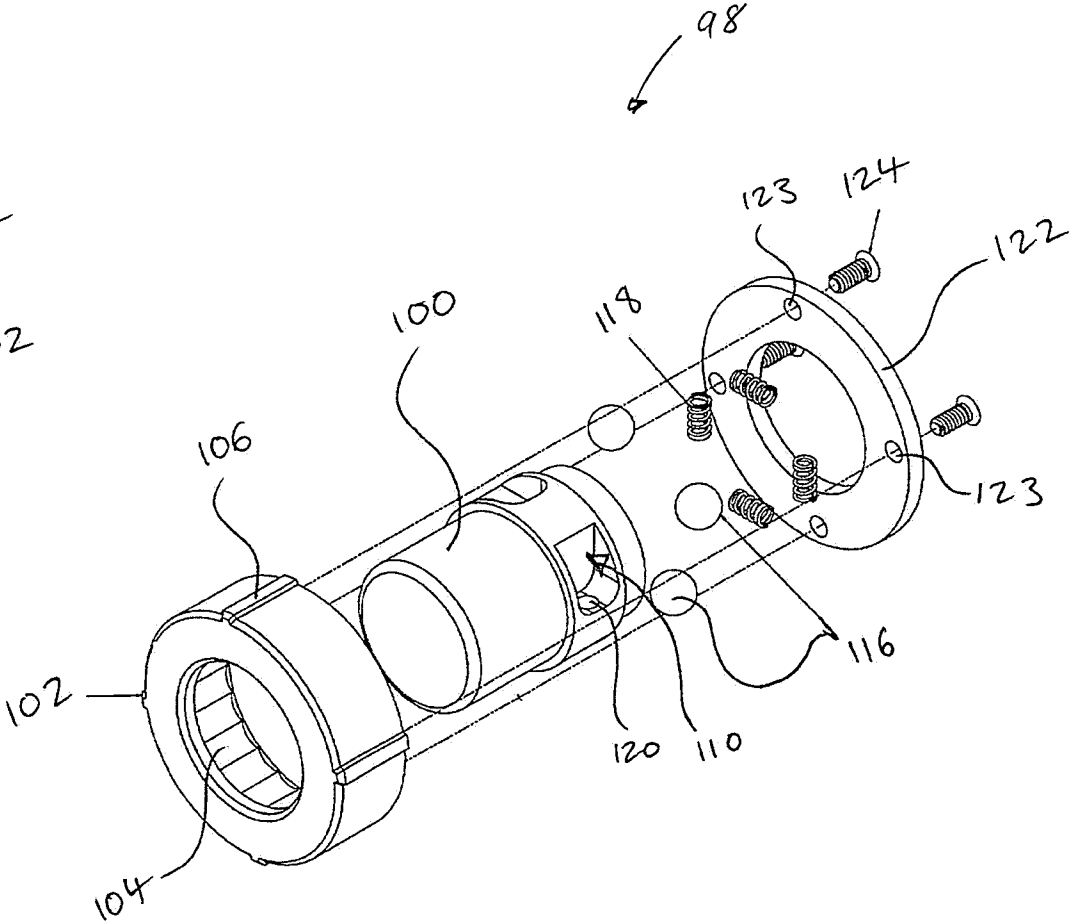
FIG. 25 is an exploded view of the button and clutch assembly of FIG. 24.
Figure 24:
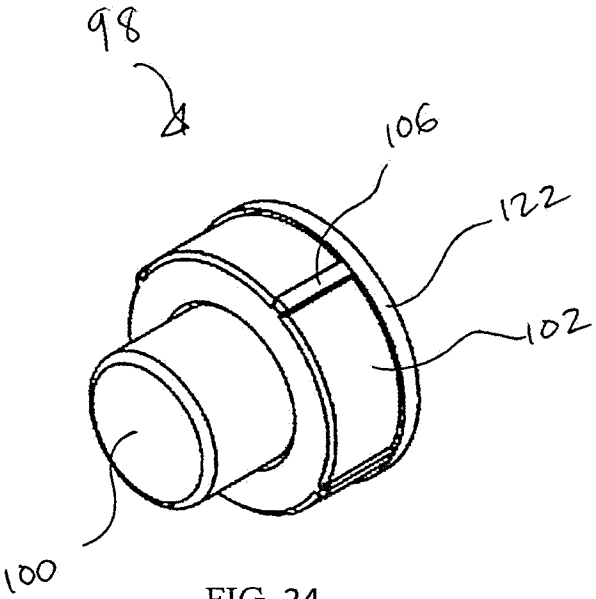
FIG. 24 is a front perspective view of a button and clutch assembly of FIG. 14.
Figure 29:
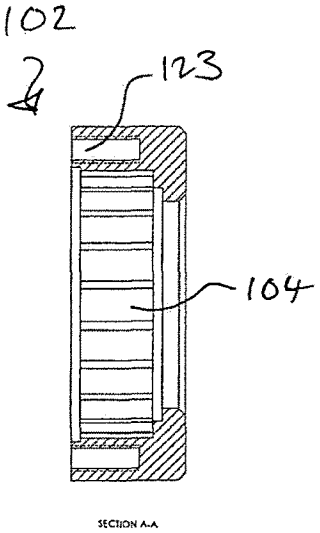
FIG. 29 is a cross-section view of the coupling ring of FIG. 28.
Figure 28:
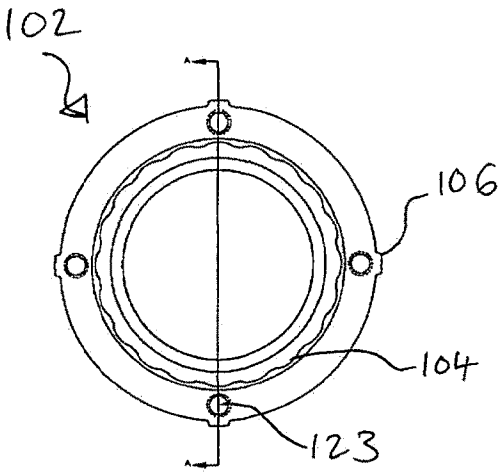
FIG. 28 is a rear view of the coupling ring of FIG. 26.
Figure 26:
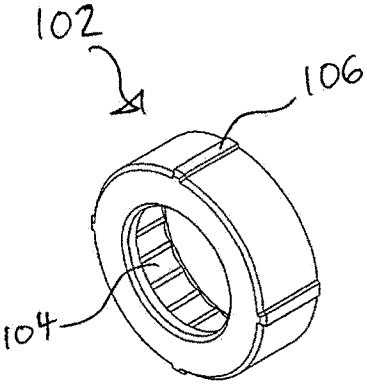
FIG. 26 is a front perspective view of a coupling ring of FIG. 25.

Turning now to FIGS. 20-23, the first hinge member 62 includes a cap portion 63 having circular aperture 68 (e.g., button aperture) configured to receive a protruding portion of the button 100 of the button and clutch assembly 98 there through, one or more optionally integral connecting arms 64, and a lower end that engages the second hinge member 72 as a second type of rotational connection between the two hinge members. The cap 63 can be integral (e.g., formed as a single continuous piece) with the connecting arms 64, as shown. The second hinge member includes spline features 70, which can be female as shown, male, or any other spline feature that is shaped to interface with complementary spline features 106 of the second hinge member 72. Also as shown, the first hinge member 62 includes threaded connection points 66 at distal ends of the connecting arms 64 (e.g., configured to attach to one or more coupling devices 130). FIG. 23 is a cross-section view of the first hinge member 62 according to line B-B as shown in FIG. 22.

The inside portion of the first hinge member 62 is substantially round or cylindrical as shown and includes four spline features 70 spaced at 90-degree increments around the inside portion of the first hinge member 62. The spline features 70 can be linear slots in the first hinge member 62 that extend longitudinally. The spline features 70 can also be linear ribs, or any other spline feature complementary to spline features 106 of the second hinge member 72.

With reference now to FIGS. 15-19, the second hinge member 72 is described. The second hinge member 72 is a generally cylindrical member configured to attach to a support structure 33 and to the first hinge member 62. The first hinge member 62 and the second hinge member 72, may each be sized such that the two parts can be concentrically press-fit, pressure-fit, friction-fit, or otherwise attached to each other according to any suitable construction. In some embodiments, the first hinge member 62 and second hinge member 72 are configured to allow releasable attachment and removal from each other, for example during assembly, maintenance, repair, and the like.

Figure 16:
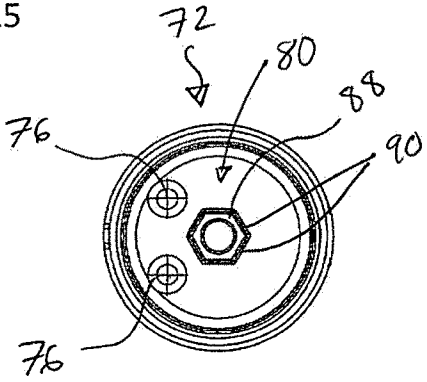
FIG. 16 is a front view of the second hinge member of FIG. 14.
Figure 15:
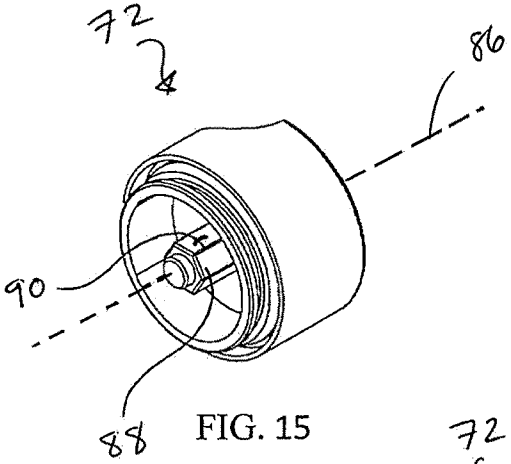
FIG. 15 is a front perspective view of a second hinge member of FIG. 14.
Figure 32:
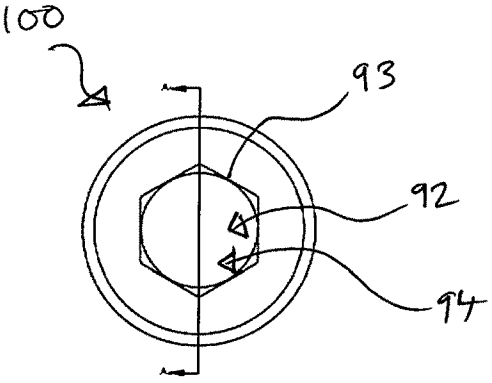
FIG. 32 is a rear view of the button and clutch assembly of FIG. 30.
Figure 33:
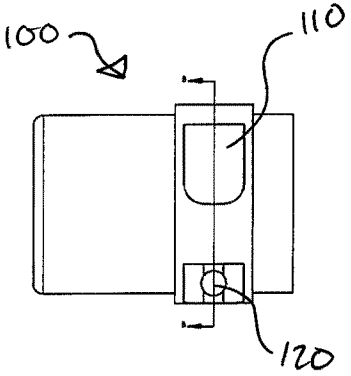
FIG. 33 is a side view of the button and clutch assembly of FIG. 30.
Figure 34:
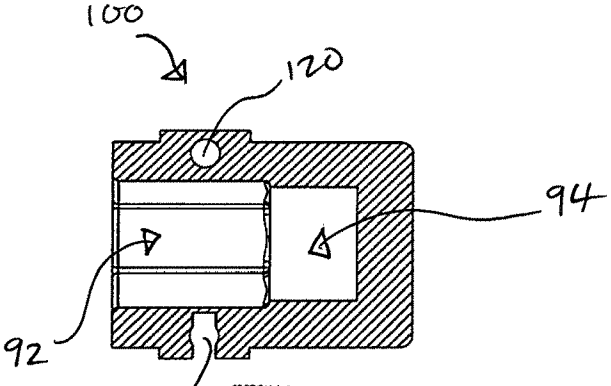
FIG. 34 is a cross-section view of the button and clutch assembly of FIG. 32.

Second hinge member 72 includes an inner post 88, which axially projects from the second hinge member 72 along a post axis 86 (e.g., as shown in FIG. 14), such that one or more recessed wells 80 are formed adjacent to the inner post 88. In some embodiments, second hinge member 72 defines an arcuate well 80 that at least partially (e.g., completely) surrounds inner post 88. The inner post 88 can be faceted with one or more facets 90, and can have a linearly extended polygonal shape (e.g., hexagonal, as shown). As shown in FIGS. 15 and 16, the facets extend substantially parallel to the post axis 86. The facets 90 are complementary to the shape of the outer post sleeve 92 and outer post sleeve facets 93 (e.g., as shown in FIG. 32), to facilitate axial movement of the outer post sleeve 92 along the inner post 88 (e.g., parallel to the post axis 86) while relative rotation is limited (e.g., precluded, restricted, inhibited).

The second hinge member 72 can include an arcuate, circular, or cylindrical indent 74 (e.g., a groove, a recess, a pocket, etc.) configured to receive for attachment to a complementarily-shaped or suitable contour that matches a shape of a surface where it is mounted. As shown, the contour is defined by of a frame or leg, such as of support structure 33, that is received by the indent 74. The indent 74 can be offset from center (e.g., offset from the post axis 86), as shown in order to attach the second hinge member 72 to the support structure 33 in various configurations and positions. The indent 74 can be offset so that mounting does not interfere with operational components of the hinge assembly 38. The indent 74 can include one or more apertures 76 shaped to receive fasteners there through, such as bolts or screws. In some embodiments, the apertures 76 are female threaded and shaped to receive male-threaded fasteners to facilitate attachment of the second hinge member 72 to the structure 33. Such attachment may be performed prior to assembly of the first hinge assembly 38. Coupling the second hinge member 72 to the structure 33 before assembly of the first hinge assembly 38 may facilitate exposing the apertures 76 during assembly, which might otherwise be obstructed (e.g., closed off or hidden) once the first hinge assembly 38 is assembled.

Figure 19:
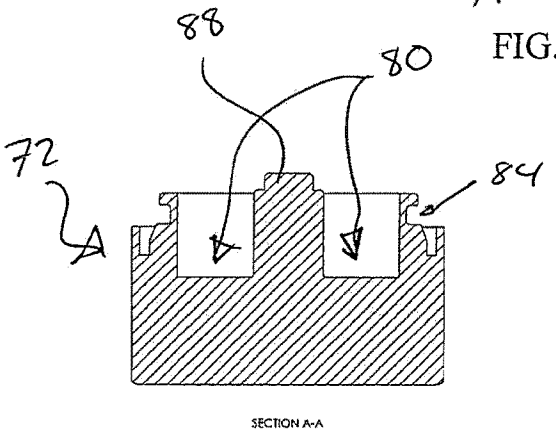
FIG. 19 is a cross-section view of the second hinge member of FIG. 18.
Figure 17:
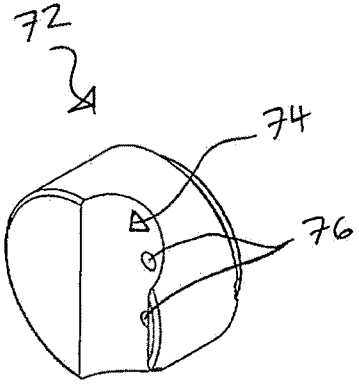
FIG. 17 is a rear perspective view of the second hinge member of FIG. 15.

Referring to FIGS. 14, 19, and 23, a retaining ring 82 can be located in a circumferential groove 83 of the first hinge member 62 and extend into a gap between the first hinge member 62 and the second hinge member 72. The circumferential groove 83 may be formed on an interior surface of the first hinge member 62 such that the circumferential groove 83 opens radially inward. In some embodiments, the retaining ring 82 is also received in a corresponding circumferential groove 84 defined by the second hinge member 72. As shown, the circumferential groove 84 is formed on an exterior surface of the second hinge member 72 such that the circumferential groove 84 opens radially outward. The retaining ring 82 can be sized, shaped, and constructed so as to be resiliently insertable at one or more rotational connections between the first hinge member 62 and the second hinge member 72. The retaining ring 82 can be a toroidal O-ring, and can promote a relatively tight, secure, yet rotational and removable fit of the components once assembled together. The retaining ring 82 can introduce a degree of friction between the first hinge member 62 and the second hinge member 72, for example, to reduce unwanted or excessive free spinning of the overall first hinge assembly 38.

Retaining ring 82 may also facilitate more precise guidance of rotational movements between components of the first hinge member 62 and the second hinge member 72. In some embodiments, the retaining ring 82 can be composed of various elastomeric, plastic, or other compliant or resilient materials to facilitate controlled rotation so a shield 28 connected to the first hinge assembly 38 does not freefall even when released. In other embodiments, the retaining ring can be formed of various low friction materials (e.g., high molecular weight polyethylene or a fluro-polymer such as polytetrafluoroethylene) or any other substance as appropriate.

Referring to FIGS. 24-35, the button and clutch assembly 98 is shown according to an exemplary embodiment. The button and clutch assembly 98 can include various features facilitating rotational adjustment of the shield 28 (e.g., rotation of the shield 28 about the post axis 86), including selectively releasing the shield 28 to rotate in at least one direction. The button and clutch assembly 98 includes various components, including a button 100, a coupling ring 102 having a series of radially-spaced internal recesses or nodes 104 around an inner annular surface, a button ring 122 defining apertures 123 shaped to receive one or more fasteners 124, and a rotational connection, such as a one-way rotational clutch system. The nodes 104 can include scallops, indentations, recesses, notches, grooves, or any other suitable shape. Together, the inner post 88, the button 100, and the coupling ring 102 provide a clutch system that can be actuated (e.g., engaged or disengaged) on demand. The clutch system can include components configured to interface with the internal nodes 104 (e.g., clutch elements, clutch members, etc.), shown as as bearing members 116. As shown, the clutch system includes four bearing members 116, although the clutch system may include any number of bearing members 116 and likewise any number of button pockets 110. Each bearing member 116 is coupled to a recess 120 of a button pocket 110 through a biasing member or resilient member (e.g., a spring, one or more pieces of resilient material such as rubber, a container of a compressed fluid, such as nitrogen, etc.), shown as bearing spring 118.

The button and clutch assembly 98 includes a coupling ring 102 that is configured to have functions and features to assist both a first rotational connection and a second rotational connection, as described herein. The coupling member as used herein can include the button and clutch assembly 98 in addition to the inner post 88 of the second hinge member 72. The coupling ring 102 may be ring-shaped (i.e., annular) and may define an inner aperture or opening sized and shaped to fit over the button 100 when assembled as the button and clutch assembly 98 such that the button 100 extends through the inner aperture. The coupling ring 102 also includes spline features 106 complementary to spline features 70. The coupling ring 102 can have spline features 106 that as shown protrude from an exterior of the coupling ring 102 of the button and clutch assembly 98 (e.g., extending radially outward from an exterior surface of the coupling ring 102), as described herein.

The button 100 is a portion of the button and clutch assembly 98. In some embodiments, the button is a single-piece member. The button 100 includes a top portion configured to be selectively depressed by a user along the post axis 86. The button 100 further includes various features for use with a first rotational connection. With reference to FIG. 13, the button 100 includes an upper, outwardly-protruding portion of the button and clutch assembly 98 when assembled.

A lower portion of the button 100 defines a faceted recess. The lower portion is also referred to herein as an outer post sleeve 92 and defines an outer post cavity 94 having outer post (e.g., female) facets 93. The outer post sleeve 92 and outer post cavity 94 are part of a post feature of the second hinge member 72. The outer post sleeve 92 can axially shift relative to the inner post 88. Axially adjacent the outer post sleeve 92 can be the outer post cavity 94, which can receive a portion of the inner post 88. The outer post sleeve 92 can be shaped to axially shift relative to, yet rotationally fix to the inner post 88 of the second hinge member 72. Therefore, rotation between the inner post 88 and the outer post sleeve 92 is limited (e.g., prevented). In this embodiment, rotation is limited by using hexagonal geometry rather than cylindrical geometry (e.g., such that the facets 93 of the outer post sleeve 92 engage the facets 90 of the inner post 88 to limit rotation of the button 100 relative to the second hinge member 72). In some embodiments, the outer post cavity 94 is included in the outer post sleeve 92.

A biasing member or resilient member (e.g., a spring, one or more pieces of resilient material such as rubber, a container of a compressed fluid, such as nitrogen, etc.), shown as main button spring 96, biases the button 100 and button and clutch assembly 98 and can be positioned between a top surface of the inner post 88 and a surface of the outer post sleeve 92 within the outer post cavity 94 in various positions (e.g., as shown in FIG. 13). The main button spring 96 can be a single helical spring aligned with the post axis 86, and can be used to bias the button and clutch assembly 98 in an outward, or fixed, position when the button 100 is not depressed. With the button 100 in the fixed position, the shield 28 may not be rotationally released to allow the shield 28 rotationally to lower into a preset position.

Figure 35:
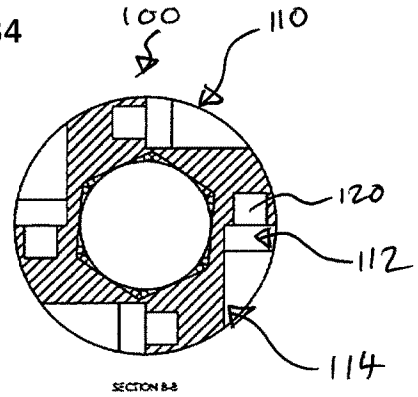
FIG. 35 is a cross-section view of the button and clutch assembly of FIG. 33.
Figure 39:
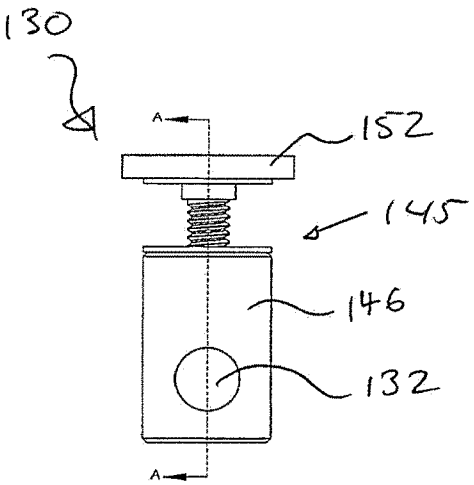
FIG. 39 is an end view of the coupling device of FIG. 36

The button 100 includes one or more button pockets 110. Each button pocket 110 receives and is operationally coupled to a corresponding bearing member 116. As shown in FIG. 35, the button pockets 110 each have a relatively deep region 112 and a relatively shallow region 114. The depth of each button pocket 110 varies along the circumference of the button 100.

In various embodiments, a bearing member 116 can be trapped in association with a corresponding button pocket 110 of the button 100 and button and clutch assembly 98. Specifically, each bearing member 116 can be received within a corresponding button pocket 110 and contained between the button 100 and the coupling ring 102. Each bearing member 116 extends out of the corresponding button pocket 110 to engage the inner surface of coupling ring 102. In some embodiments, the bearing members 116 are spherical (e.g., ball bearings). In other embodiments, the bearing members 116 are otherwise shaped (e.g., cylindrical, wedge-shaped, shaped as a triangular prism, a trapezoidal prism, or another type of polygonal prism, etc.).

In some embodiments, the bearing members 116 are each be associated with a recess 120 using a bearing spring 118. Each bearing spring 118 can be a helical spring that is biased outward radially, causing bearing members 116 to be biased against the nodes 104 of the coupling ring 102 when the button and clutch assembly 98 is assembled. In some embodiments, this biasing of the bearing members 116 can cause the bearing members 116 to operate in association with nodes 104 regardless of the orientation of the various hinge components relative to the direction of gravity. Without the inclusion of the bearing springs 118, certain bearing members 116 might not operate optimally when falling or not falling due to gravity.

Now with reference in particular to FIGS. 10-13 and 36-51, one or more couplers or coupling devices 130 can be used to couple the shield 28 to the first hinge member 62 of the first hinge assembly 38 of a food station 10. The assembled coupling device 130 can have a generally "L" shape or "T" shape in various embodiments. Each coupling device 130 can be directly coupled to one of the connecting arms 64 of the first hinge member 62.

In general, each coupling device 130 includes an standoff 132, a clamp 145 including a main body or barrel-shaped clamping base 146, a threaded clamping pad 152 configured to couple a shield 28 to the coupling device 130. The coupling device 130 may include one or more attachment washers 154. The coupling device 130 provides secure, stable, strong, reliable, affordable, visually pleasing, and safe attachment of a shield 28 to a hinge assembly, such as a first hinge assembly 38 and/or a second hinge assembly 40.

With particular reference to FIGS. 36-44, the coupling device 130 generally includes standoffs 132 and clamps 145. The coupling device 130 facilitates coupling the moveable shield 28 to the hinge assemblies 38 and 40. The structure of coupling device 130 facilitates positioning the clamps 145 at proper locations to engage with mounting holes in the shield 28. In some applications, the placement of such holes is specified by food regulations and standards to be a certain distance inward from edges of the shield 28.

Each connecting arm 64 projects outward from the first hinge member 62. The arms 64 can be separate members that are attached to first hinge member 62 or can be integrally formed with first hinge member 62. For purposes of illustration, the arms 64 are shown as being integrally formed with the first hinge member 62. For some embodiments, the connecting arms 64 are considered functionally to be part of the connecting structure provided by the coupling device 130.

The standoffs 132 and the clamps 145 include features that facilitate the coupling device 130 being easily assembled using simple, inexpensive mechanical attachment techniques without having to resort to more expensive welding or brazing at connections between either end of the standoffs 132 and other components. In other embodiments, welding, brazing, or the like are used. A key challenge when assembling such components with mechanical connections is to ensure that the components are all properly aligned so that the clamps 145 are able to properly engage mounting holes in the shield 28. Such alignment concerns may motivate the use of welding or brazing, as these can be used with any relative orientation of the components to help ensure that the clamps 145 and mounting holes properly engage. An innovation of the present disclosure is to incorporate complementary features into the standoffs 132 and the clamps 145 so that the clamps 145 can be installed properly on the standoffs 132 no matter how the standoffs 132 are axially oriented.

In more detail, each standoff 132 generally extends from a proximal or first end 134 to a distal or second end 138. The first end 134 includes threads 136 is threaded to engage complementary threaded features in the corresponding arm 64 according to a first attachment interface or connection associated with the standoff 132. A thread locking compound and/or feature can be used to help make the threaded connection more secure. Optionally, other mechanical attachment techniques may be used such as rivets, pins, clamps, combinations of these, and the like.

It can be difficult to ensure a precise axial orientation of the standoff 132 at the time that threaded engagement with the arm 64 is complete. Accordingly, standoff 132 incorporates a mechanical engagement feature that functionally engages with clamp 145 no matter how standoff 132 is axially oriented when fully tightened. In other words, clamp 145 can be installed in a proper orientation on standoff 132 and mechanically secured no matter how the standoff 132 is axially oriented.

This universal connection advantage is provided in part by forming an engagement feature on standoff 132 between first end 134 and second end 138 that is rotationally symmetric so as to present the same kind of orientation for attachment to a clamp 145 regardless of the axial orientation of standoff 132. In illustrative embodiments, this is provided by an annular or circumferential groove, slot, notch, or recess, shown as groove 140, formed circumferentially around the perimeter of standoff 132. This feature can be at any axial position on the standoff 132 that is intended to be housed inside a clamp 145. Optionally, multiple features can be used so that an attachment position can be selected from two or more options. As described further below, the groove 140 can be housed inside clamp 145. By way of example, the standoff 132 can be inserted through an aperture defined by the clamp 145 until the groove 140 aligns with the clamp 145. Then, a set screw or other suitable mechanical fastening technique can be used to engage the engagement feature to lock the clamp 145 in place on the standoff 132 (e.g., limiting at least movement of the clamp 145 axially along a length of the standoff 132). Because the groove 140 extends around the entire circumference of the standoff 132, the groove 140 can be engaged by the set screw or other mechanical fastener no matter how the clamp 145 is oriented on the standoff 132.

The clamp 145 includes a clamping base 146 and clamping pad 152. The clamping pad 152 can be secured and tightened onto the base 146 in order to securely hold the shield 28 sandwiched between the clamping base 146 and the clamping pad 152. The clamping pad 152 may extend through a mounting hole defined by the shield 28.

Figure 40:
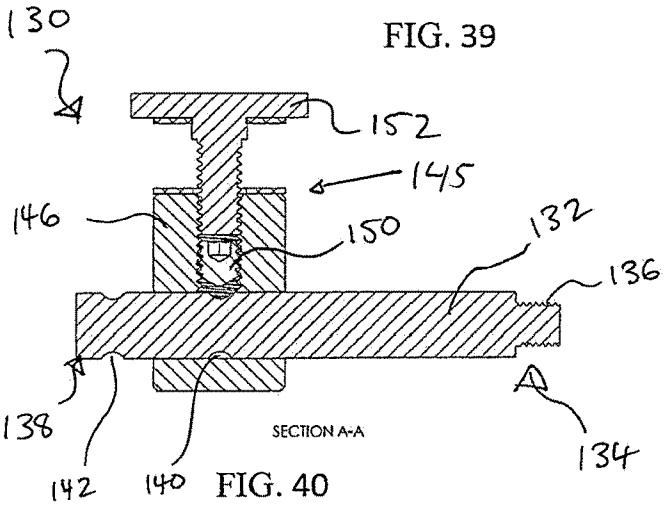
FIG. 40 is a cross-section view of the coupling device of FIG. 39.
Figure 38:
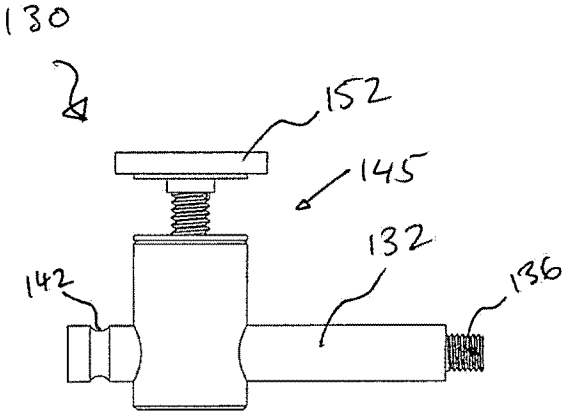
FIG. 38 is a side view of the coupling device of FIG. 36.
Figure 37:
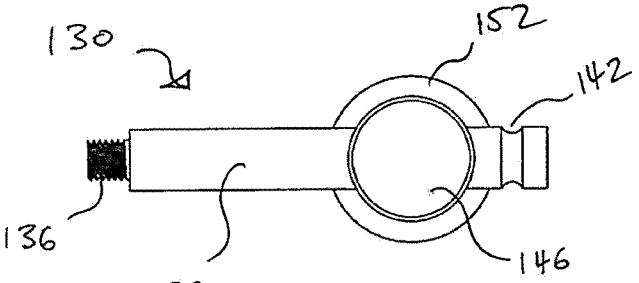
FIG. 37 is a bottom view of the coupling device of FIG. 36.
Figure 36:
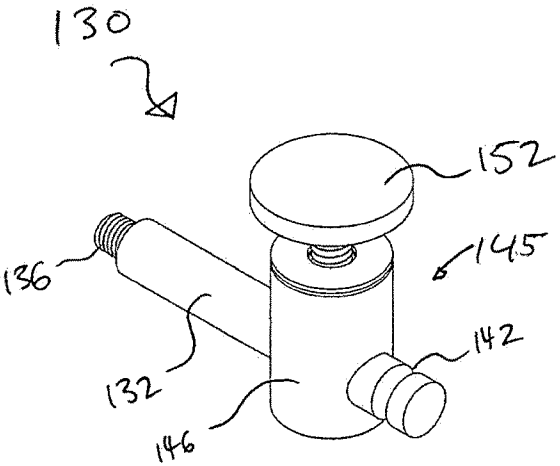
FIG. 36 is a front perspective view of a coupling device of FIG. 10
Figure 41:
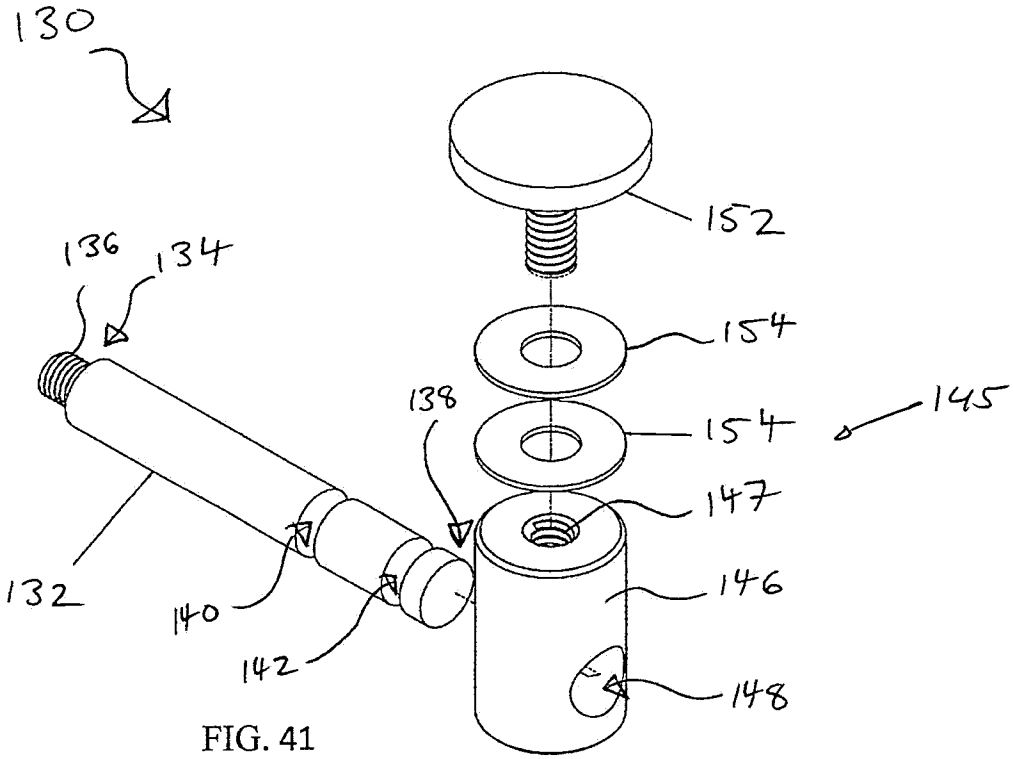
FIG. 41 is an exploded view of the coupling device of FIG. 36.
Figure 45:
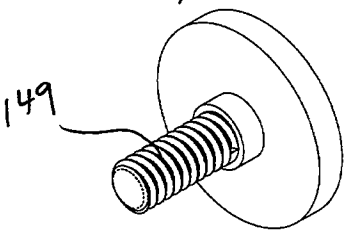
FIG. 45 is a front perspective view of a threaded fastening member of FIG. 41.
Figure 44:
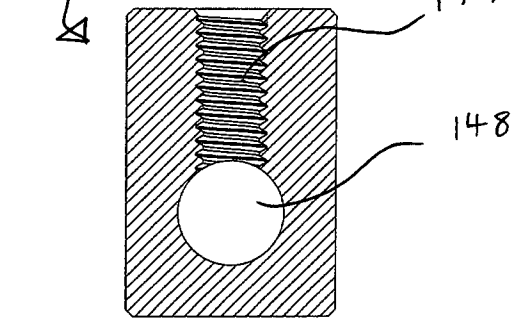
FIG. 44 is a cross-section view of the clamping base of FIG. 43.
Figure 43:
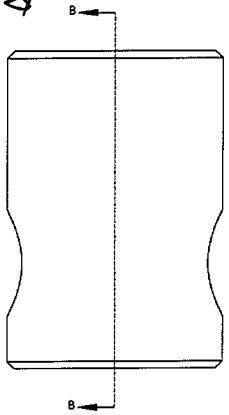
FIG. 43 is a side view of the clamping base of FIG. 42.
Figure 42:
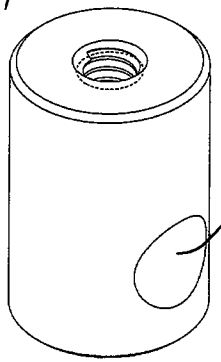
FIG. 42 is a front perspective view of a clamping base of FIG. 41.
Figure 47:
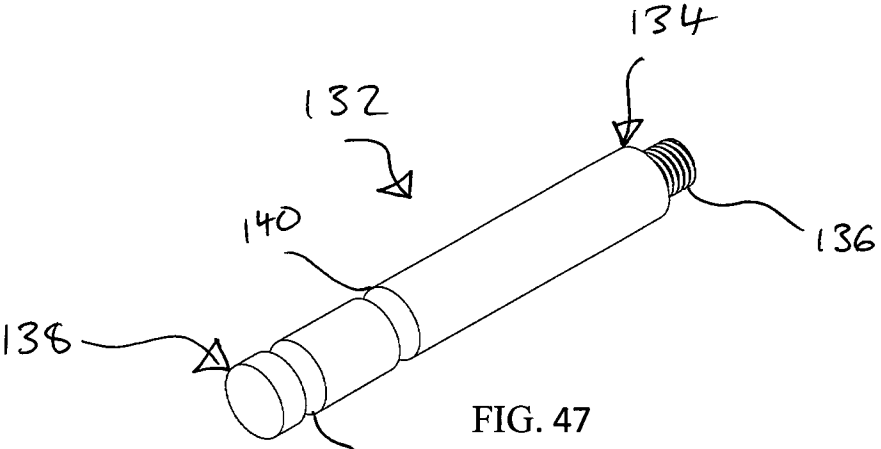
FIG. 47 is a rear perspective view of the standoff of FIG. 46.
Figure 46:
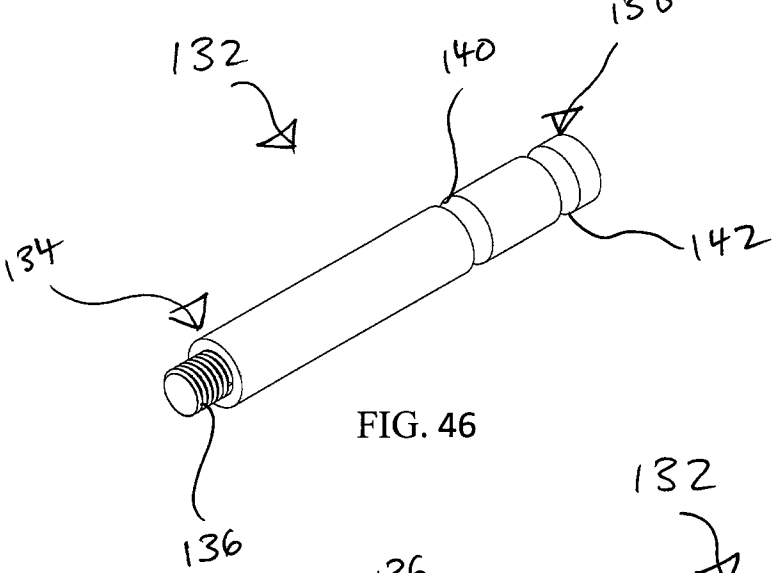
FIG. 46 is a front perspective view of a standoff of FIG. 41.
Figure 48:
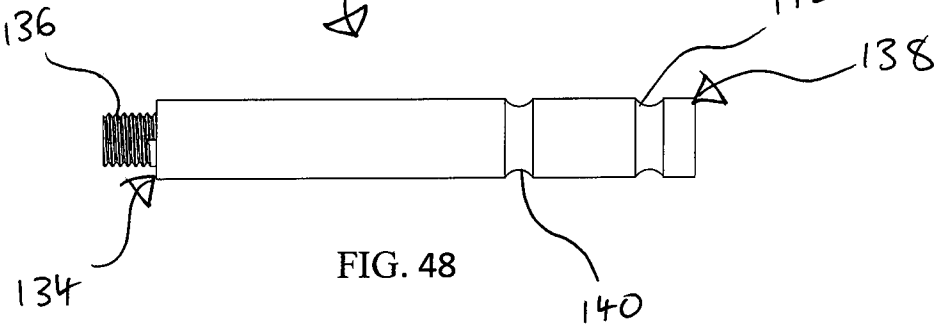
FIG. 48 is a side view of the standoff of FIG. 46.
Figure 51:
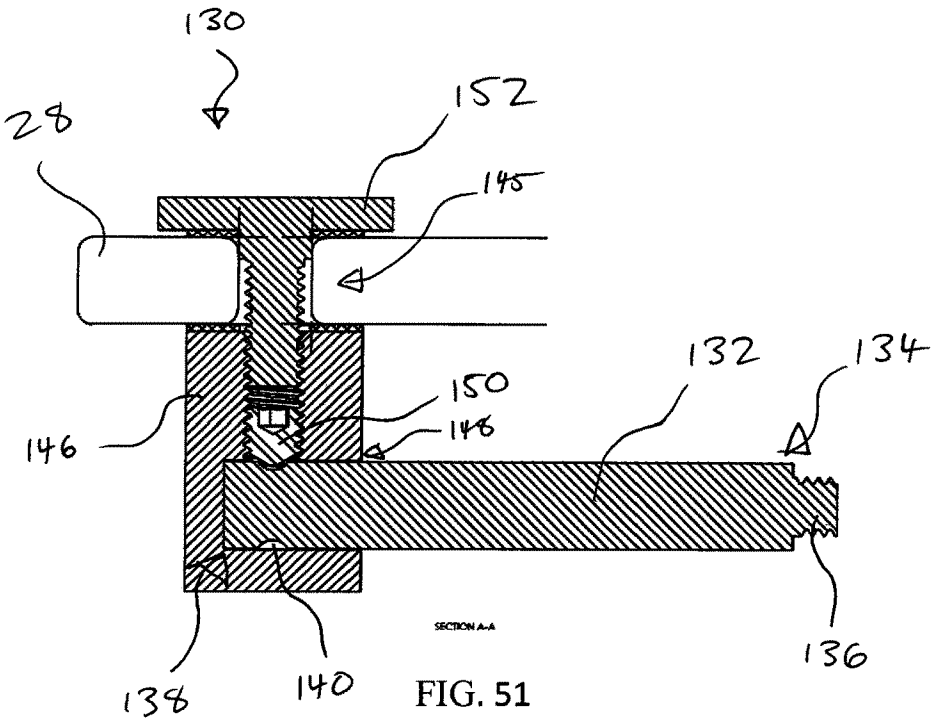
FIG. 51 is a cross-section view of the embodiment of the coupling device of FIG. 50.

The clamping base 146 includes a first pocket 148 (e.g., an aperture, a recess, etc.) that holds the standoff 132. This pocket 148 may extend only partially through base 146 so it has a single egress (e.g., as shown in FIG. 51). Alternatively, the first pocket 148 may extend through the base 146 such that the first pocket 148 has two egresses (e.g., as shown in FIG. 40). A through bore may be desirable if the standoff 132 may extended fully through the base 146 such that portions of standoff 132 extend from base 146 on both sides. The interior of pocket 148 may have a smooth contour to facilitate installation and removal of the standoff 132.

The clamping base 146 includes a second pocket 147 (e.g., an aperture, a recess, etc.) that extends from the clamping face of the base 146 that seats against the shield 28 far enough to open into (e.g., intersect) the first pocket 148. The second pocket 147 supports two independent functions. First, at least a portion of the second pocket 147 may be threaded in a manner to complement threads on a set screw 150. This permits the set screw 150 to be driven into the second pocket 147 and secured against the standoff 132 housed in the first pocket 148. When the groove 140 is housed inside the base 146 and in alignment with the second pocket 147, the set screw 150 can be driven down into the groove 140 to help lock the standoff 132 in place. Thread compound may be used on the threaded engagement to help secure the connection.

As a further function, the second pocket 147 may engage with a complementary feature on the clamping pad 152 to help secure and tightly hold clamping pad 152, and therefore the shield 28, to the base 146. To this end, clamping pad 152 includes a threaded stud that threadably engages complementary threads inside the second pocket 147. The threaded stud and the set screw 150 may have similar corresponding threads (e.g., threads of the same diameter and pitch).

The first hinge 38 includes button and clutch functionality that controls the ability to rotate the hinge assemblies 38 and 40, and hence the shield 28, in either the raising or lowering rotations. In one configuration, the button and clutch functionality restricts lowering rotation (i.e., rotation of the hinge that moves the shield 28 in a downward direction) but permits raising rotation (i.e., rotation of the hinge that moves the shield in an upward direction). Because lowering rotation is restricted, the shield 28 can be raised and supported by hinge assemblies 38 and 40 in multiple raised positions as desired without the shield 28 lowering due to the force of gravity. In a second configuration, the button and clutch functionality permits actuation to shift the hinge assemblies 38 and 40 from the first configuration to a second configuration that permits lowering rotation of shield 28. The actuation is easily released so that the first configuration is quickly restored by a bias in the hinge function. This means that the clutch functionality can be engaged to permit lowering rotation but then quickly disengaged so that lowering rotation is once again prevented. This permits the shield 28 to be lowered controllably to one or more lowered positions through a desired range of motion.

Now turning to the operation of the first hinge assembly 38 of the food station 10, two rotational connections between the first and second hinge members 62 and 72 are described.

The operation of the first rotational connection is described with reference to FIGS. 13, and 24-35. The first rotational connection can include various components of the button and clutch assembly 98, and can be fully internal to the button and clutch assembly 98.

The operation of the first rotational connection involves components of the button and clutch assembly 98. The relative rotation between the first hinge member 62 and the second hinge member 72 is permitted or restricted depending on how the bearing members 116 interact with the interface between the coupling ring 102 and the outer post sleeve 92. Because rotation of the outer post sleeve 92 is limited relative to the post 88 and the post 88 is fixed to the second hinge member 72, relative rotation of the hinge members 62 and 72 is controlled by (a) relative rotation of the button 100 and coupling ring 102 and (b) relative rotation of the coupling ring 102 and the first hinge member 62. In the absence of a rotation actuation force (e.g., a torque on the hinge caused by the weight of the shield 28), the bearing members 116 are biased by the springs 118 to be positioned in the relatively shallow regions 114 of the pockets 110 and up against one of the nodes 104. This jams the interface to restrict further rotation against this obstruction. Specifically, further rotation of a hinge in a jamming direction would cause the coupling ring 102 to drive the bearings 116 (e.g., through friction, through geometric engagement of the bearings 116 within the nodes 104) further away from the deeper regions 112 and further into the shallow regions 114. This decreases the amount of space available for the bearing members 116, increasing friction and the opposing further rotation in the jamming direction such that relative rotation of the hinge elements is limited (e.g., prevented, inhibited, opposed, etc.) in one direction. The hinge assemblies 38 and 40 are configured and installed so that this bias against rotation restricts lowering the shield 28. If attempts are made to further lower shield 28, the jamming force increases as bearing members 116 are driven harder into the interface. This effectively prevents the lowering rotation.

In effect, the clutch functionality by which the coupling ring 102 is attached to the second hinge member 72 restricts coupling ring 102 so that coupling member can only rotate in a direction that corresponds to raising shield 28. In the first configuration in which lowering rotation of shield 28 is restricted, the spline features 106 of the coupling ring 102 are engaged with the complementary spline features 70 on the first hinge member 62. Consequently, the rotation freedom of the first hinge member 62 is restricted by the coupling ring 102. This means the first hinge member 62, and hence the shield 28, can only be rotated in the direction that corresponds to raising the shield 28.

In contrast, when the hinge assemblies 38 and 40 are rotated the other direction (e.g., in a free movement direction), the rotational force tends to drive the bearing members 116 into the deeper regions 112 of the pockets 110 against the bias of the springs 118. This removes the jamming effect, which in turn permits free rotation in that direction. The hinge assemblies 38 and 40 are configured and installed so that this free rotation corresponds to raising the shield 28.

To permit rotation in the other direction so that the shield 28 can be lowered, the button 100 is pushed and held against the bias of spring 96. This causes the coupling ring 102 to axially shift down the post 88. The complementary spline features 106 of the coupling ring 102 are axially shifted away from and out of engagement with the complementary spline features 70 on the first hinge member 62, permitting relative rotation between the coupling ring 102 and the first hinge member 62. Although the coupling ring 102 is still restricted from rotation in the direction corresponding to raising the shield 28, the first hinge member 62 is now released from this restriction and can rotate in the other direction to permit the shield 28 to be lowered. When the button 100 is released, the spring 96 axially shifts the button and clutch assembly 98 to cause the complementary spline features of the mechanism to engage once again to prevent relative rotation between the first hinge member 62 and the coupling ring 102 and thus prevent rotation corresponding to lowering the shield 28.

In the first rotational direction, adjacent nodes 104 are angularly offset from one another to define an angle spacing of the nodes 104. The angle spacing between adjacent nodes 104 can determine set intervals. Therefore, fewer but large nodes 104 would permit less granular adjustment of the shield 28 in the first rotational direction. The single-direction first rotational connection mechanism can operate by the bearing member 116 being caused to become lodged in the relatively shallow region 114 when the coupling ring 102 is moved in the rotational direction having restriction, and the bearing member 116 being caused to become stowed in the relatively deep region 112 when the coupling ring 102 is moved in the (first) rotational direction having generally free or less restricted movement.

During testing, the addition of the bearing springs 118 (compared to freely movable bearing members 116) led to a smoother, more positive engagement of the first rotational connection mechanism. Wear and tear on the various components of the first rotational connection mechanism were also be improved with the inclusion of the bearing springs 118. Nevertheless, in various embodiments, the bearing springs 118 and/or the recesses 120 for spring attachment can be omitted without substantially altering the operation of the button and clutch assembly 98. As described below, the button 100 can axially shift the button and clutch assembly 98, thereby causing a rotational release of the second rotational connection in at least one rotational direction. The bearing-based rotational mechanism of the first rotational connection mechanism can, however, operate as a one-way clutch regardless of any operation of a spline-based clutch of the second rotational connection, described further below.

In various embodiments, the coupling ring 102 rotatably couples the first and second hinge members 62 and 72 to each other by both a first rotational connection and a second rotational connection, as described in further detail herein.

In some embodiments, the coupling ring 102 is rotatably coupled to the post (including inner post 88 and outer post sleeve 92) by the first rotational connection that includes an interface between the coupling ring 102 and the post that allows the coupling ring 102 to be rotated in a first rotational direction relative to the post axis 86 and that substantially restricts rotation of the coupling ring 102 in a second rotational direction relative to the post axis 86.

The operation of the second, selectively releasable, rotational connection is shown best with reference to FIGS. 14-23, and is described in greater detail, below.

The various components of the button and clutch assembly 98 operate to create a first rotational connection between various components of the first hinge assembly 38, as described above. In order to create a (second) rotational connection between two (optionally different) components, in some embodiments, the second hinge member 72 includes a first spline feature (e.g., spline features 70). The coupling ring 102 can also include one or more second, external spline features (e.g., spline features 106) that are complementary to the one or more first spline feature(s).

The coupling ring 102 can be axially biased in the first configuration using the main button spring 96, and selectively releasable (e.g., using button 100) such that the coupling ring 102 longitudinally (e.g., along post axis 86) axially shifts the first spline feature 70 of the second hinge member 72 relative to the second spline feature 106 between the first (fixed) configuration and the second (released) configuration. In the second configuration, the second rotational connection is caused to be rotatable in at least the second rotational direction relative to, and/or about, the post axis 86.

A mechanism for the second rotational connection can be released by selectively pushing the button 100 (of the first hinge assembly 38 and/or the second hinge assembly 40), or other method of releasing the connection of the button and clutch assembly 98 and the first hinge member 62. The main button spring 96 biases the button and clutch assembly 98 such that the button 100 and the entire button and clutch assembly 98 is pressed into the first hinge member 62 when at rest. This in effect couples the first hinge member 62 to the button and clutch assembly 98 and coupling ring 102 according to a second rotational connection mechanism.

Once released, this second rotational connection can be rotated and moved such that the spline features 106 on the coupling ring 102 are caused to slidably ride or slide upon an internal ridge 71 (e.g., as shown in FIG. 21) with an amount of pressure and friction caused at least in part by a spring constant or characteristics of the extendedly-biased main button spring 96. As shown, the ridge 71 extends circumferentially between adjacent spline features 70. In other embodiments, the spline features 70 of the first hinge member 62 can instead be shaped to slidably ride on a feature (e.g., a ridge) of the button and clutch assembly 98, the second hinge member 72, or any other component. Once released, the slidable movement of the spline features 106 on the ridge 71 can rotationally continue unless or until the external spline features 106 rotate sufficiently to align with a corresponding rotationally symmetric location on the first hinge member 62 (e.g., in this case 90 degrees of free rotation). The rotational distance (e.g., arc length) between the spline features 70, 106, and accordingly the quantity of spline features 70, 106, can be selected according to desired movement of the shield 28 when the button 100 is selectively pressed or otherwise released, as described herein.

The coupling ring 102 can be rotatably coupled to the second hinge member 72 by the second rotational connection that engages rotation of the second hinge member 72 with respect to the coupling ring 102 in both the first rotational direction and the second rotational direction relative to the post axis 86, the second hinge member 72 being selectively disengageable from the coupling ring 102. When selectively disengaged the second hinge member 72, the coupling ring 102 is permitted to be rotatable in at least the second rotational direction relative to the post axis 86.

In some embodiments, the inner post 88 is fixedly coupled to the second hinge member 72. In some, the outer post sleeve 92 is slidably coupled to the inner post 88 by inner post facets 90 interacting with (e.g., engaging) outer post sleeve facets 93, where the outer post sleeve 92 axially shifts on the inner post 88 upon engagement or disengagement of the second hinge member 72 from the coupling ring 102. Axial positioning of the outer post sleeve 92 on the inner post 88 in a first configuration causes the coupling ring 102 to engage the second hinge member 72, and axial positioning of the outer post sleeve 92 on the inner post 88 in a second (released) configuration causes the coupling ring 102 to disengage the second hinge member 72 according to a user's selective actuation of the button 100.

The female spline features 70 of the first hinge member 62 are located on an inner portion of the first hinge member 62 for selective rotational attachment of the button and clutch assembly 98 including coupling ring spline features 106 when selectively engaged. The spacing of the spline features 70 can determine what angle the shield 28 may lower when the button 100 is pressed to release the first hinge assembly 38. In other embodiments, 1, 2, 3, 5, 6, etc. splines and rotational increments can be used instead.

As discussed, the coupling ring 102 preferably also includes one or more radially spaced apart external spline features 106 for use in the second rotational connection for the first hinge member 62 spline features 70. As shown, external spline features 106 are located around a periphery of the coupling ring 102. As shown, four external spline features 106 are shown, evenly spaced at four, 90-degree rotationally symmetric intervals. In some embodiments, the number of external spline features 106 is equal to the corresponding number of internal spline features 70 found on an inside portion of the first hinge member 62 to facilitate proper button 100 release operation with respect to the second rotational connection, as described herein.

The first rotational connection and the second rotational connection can be decoupled and in series, and can operate independently of each other, although sharing the use of the coupling ring 102. The coupling ring 102 can be a component of both the first rotational connection and the second rotational connection. It should be noted that the second rotational connection mechanism including the internal/external spline features 70, 106 can operate independently of the first rotational connection, including the rotational guidance provided by the bearing members 116 in button pockets 110 mechanism as it interfaces with the internal annular side of the coupling ring 102, which includes nodes 104. Therefore, the coupling ring 102 operates both as part of a first rotational mechanism internally and a separate, second rotational mechanism externally.

Figure 49:
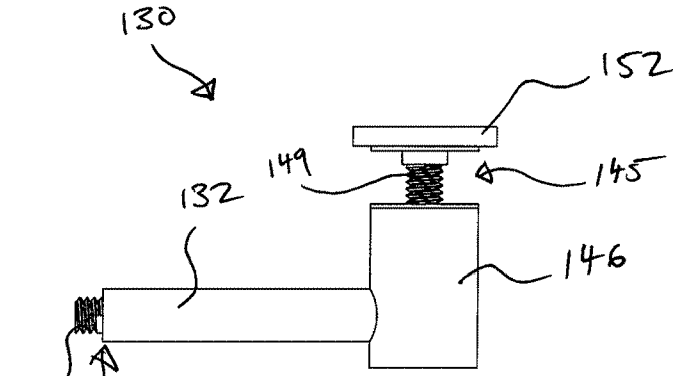
FIG. 49 is a side view of an alternative embodiment of a coupling device.
Figure 50:
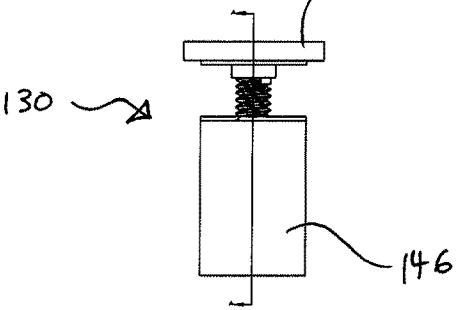
FIG. 50 is an end view of the coupling device of FIG. 49.

FIGS. 49-51 illustrate an alternative embodiment of the coupling device 130. In this embodiment, the clamping base 146 has only one smooth bore pocket 148 that extends only partway through the clamping base 146 (in addition to the perpendicular and separate threaded bore pocket 147) for receiving the standoff 132. Additionally, as shown the standoff 132 includes only the first annular groove 140, and is configured for attachment and securement within the clamping base 146 at one particular position, to be secured with the set screw 150 once the standoff 132 is inserted into the smooth bore pocket 148 of the clamping base 146 such that the standoff 132 abuts a wall of the clamping base 146 opposite the single smooth bore pocket 148 opening.

Figure 53:
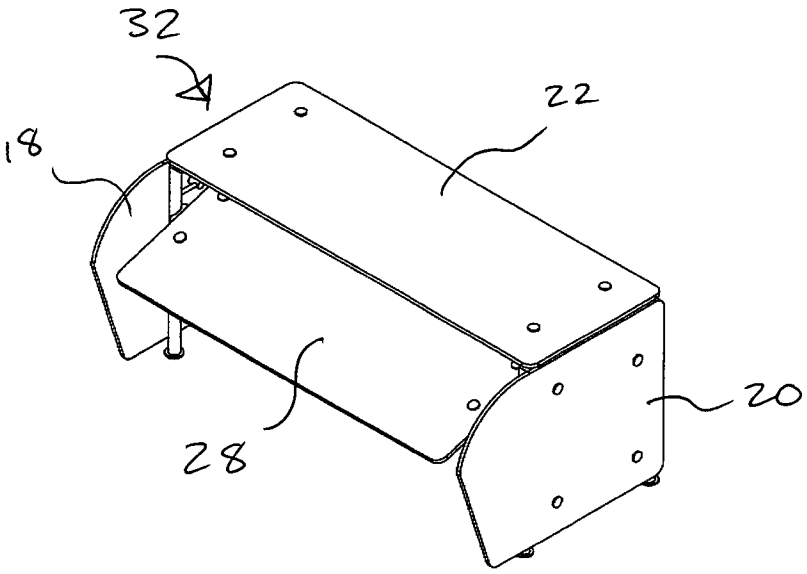
FIG. 53 is a front perspective view of the embodiment of the food station of FIG. 52 in an open position.
Figure 52:
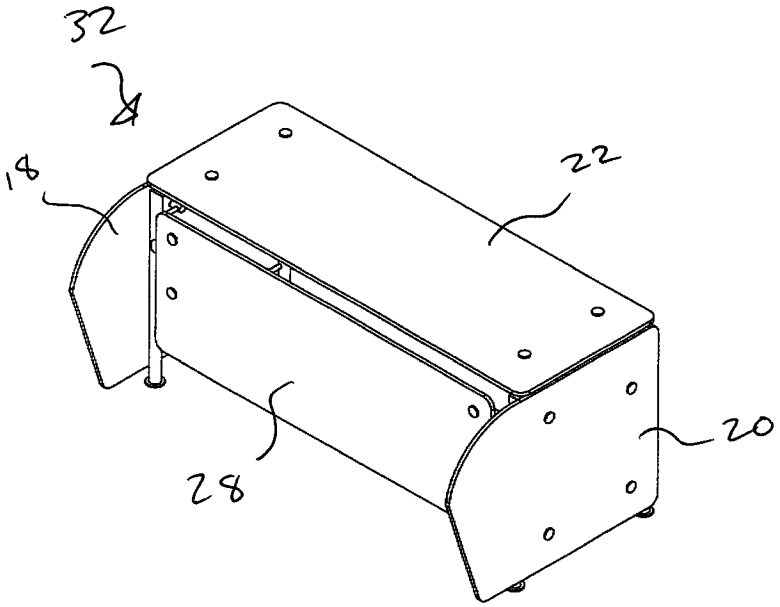
FIG. 52 is a front perspective view of an alternative embodiment of a food station in which the side panel assemblies of the protective enclosure are extended to provide a larger side barrier to protect a food supply when the selectively repositionable shield is in a closed configuration.

FIGS. 52 and 53 illustrate an alternative embodiment of the food station 10, in which the side panel assemblies 18 and 20 of the protective enclosure 32 are extended to provide a larger side barrier to protect a food supply pan 30 when the moveable and positionable shield 28 is in a closed configuration (e.g., as shown in FIG. 52) or an open configuration (e.g., as shown in FIG. 53).

Figure 55:
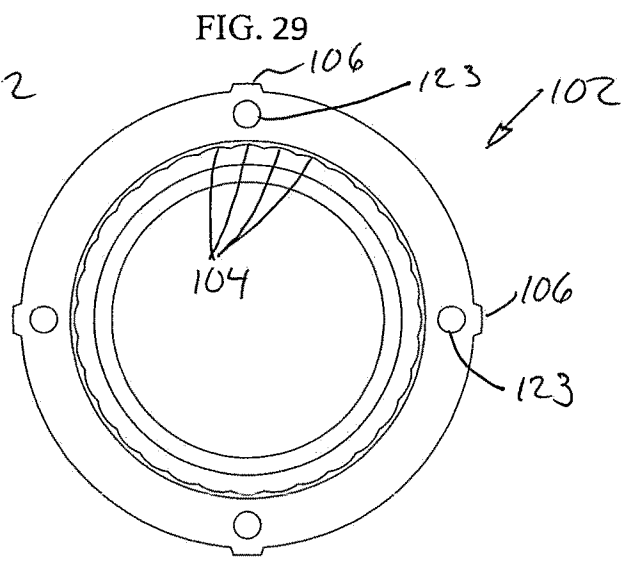
FIG. 55 is a rear perspective view of the coupling ring of FIG. 54.
Figure 54:
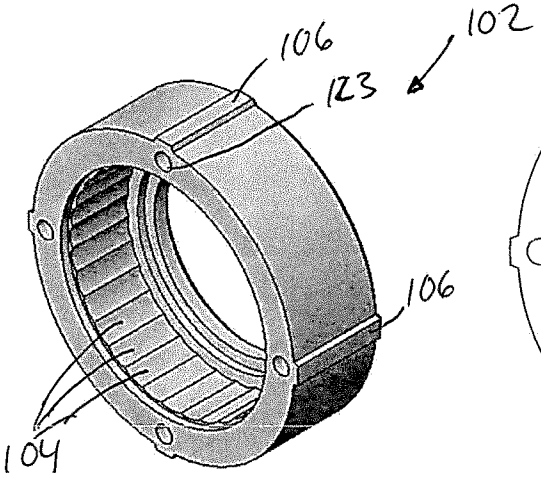
FIG. 54 is a rear perspective view of an alternative embodiment of a coupling ring.
Figure 27:
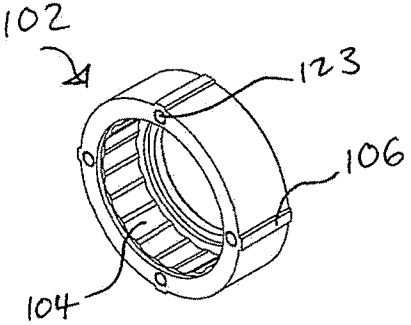
FIG. 27 is a rear perspective view of the coupling ring of FIG. 26.
Figure 30:
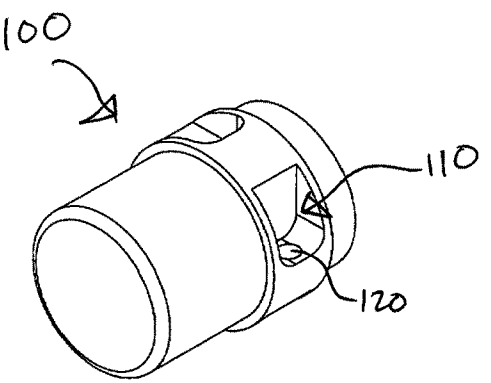
FIG. 30 is a front perspective view of a button and clutch assembly of FIG. 25.
Figure 31:
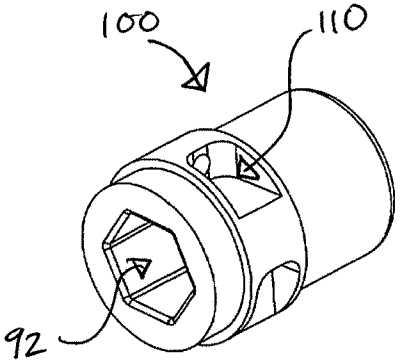
FIG. 31 is a rear perspective view of the button and clutch assembly of FIG. 30.

FIGS. 54 and 55 illustrate an alternative embodiment of the coupling ring 102. In this embodiment, the coupling ring 102 includes a greater number of nodes 104 (e.g., thirty-two nodes 104 as opposed to the twenty nodes 104 shown in FIG. 28). Increasing the quantity of the nodes 104 decreases the angular offset between the nodes 104. This provides a greater number of locations for each bearing member 116 to engage the coupling ring 102, which facilitates finer adjustment of the orientation of the hinge (i.e., increases the quantity of discrete positions or orientations in which the hinge assembly 38 can be held). In other embodiments, the coupling ring 102 includes more or fewer nodes 104. In some embodiments, the nodes 104 are omitted, and the bearing members 116 engage a smooth, continuous surface of the coupling ring 102 having a circular cross-sectional profile. This may provide infinite adjustment of the orientation of the hinge, as the bearing members 116 could engage the coupling ring 102 in any location. However, the inclusion of the nodes 104 may help to retain the hinge assembly 38 in a desired location under larger loadings without slippage.

Figure 56:
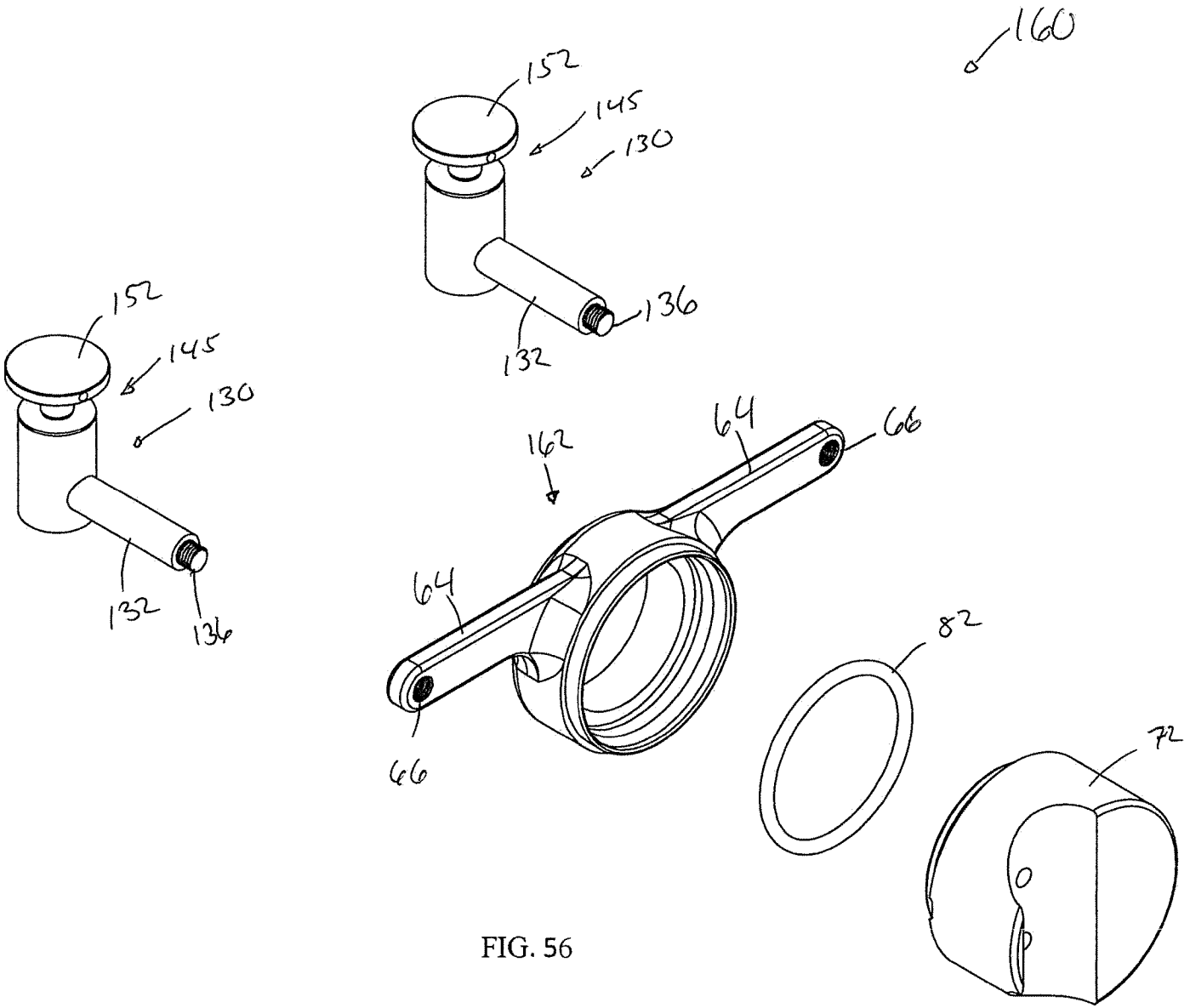
FIG. 56 is an exploded front perspective view of a hinge assembly, according to an exemplary embodiment.
Figure 57:
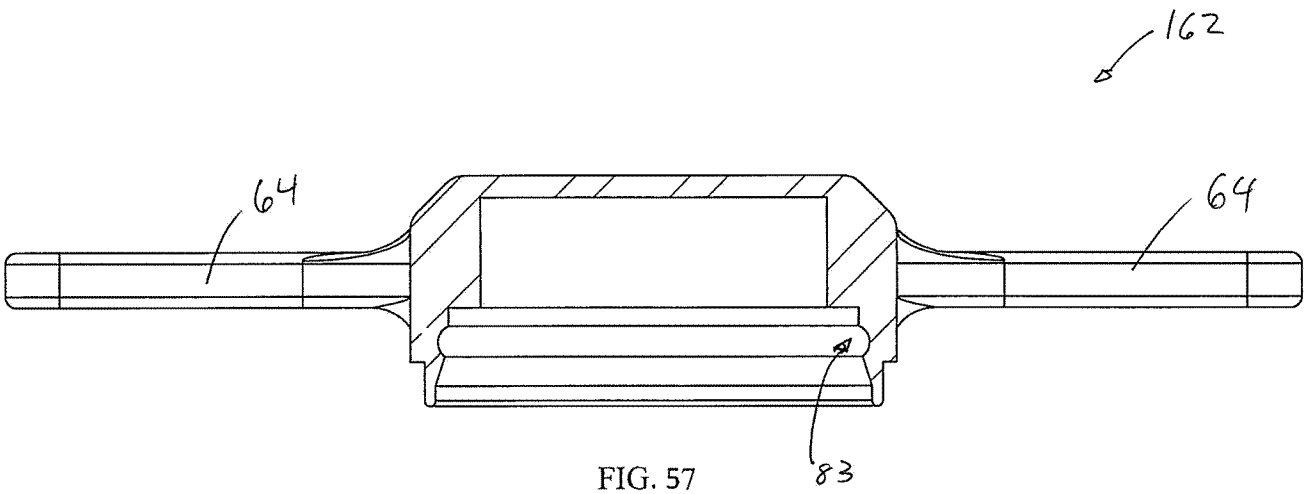
FIG. 57 is a cross-section view of a first hinge member of the hinge assembly of FIG. 56.
Figure 58:
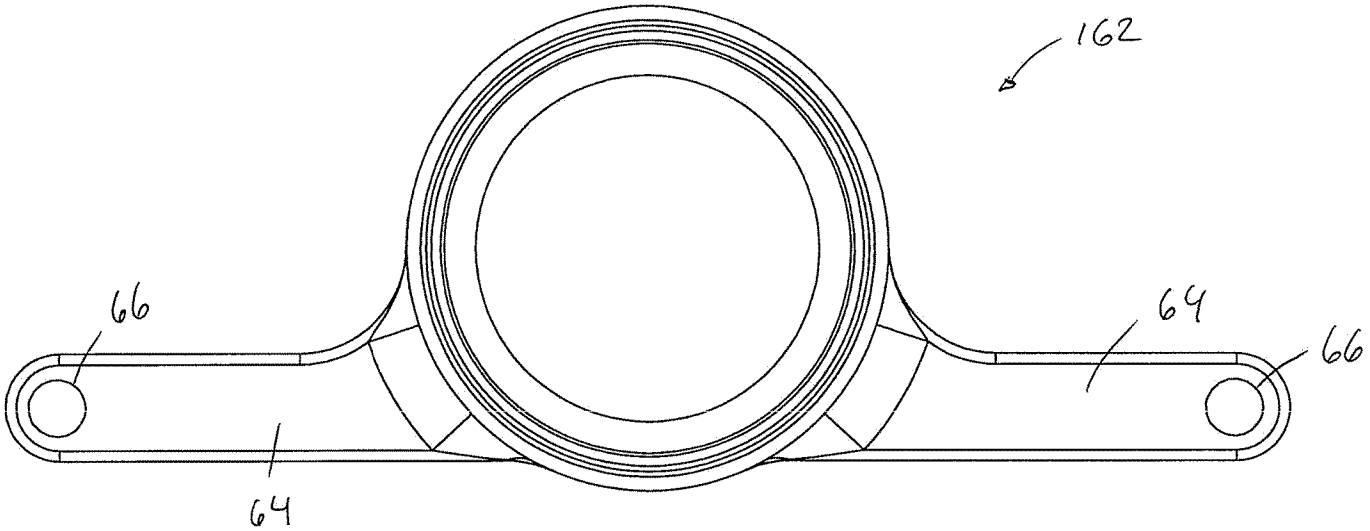
FIG. 58 is a front view of the first hinge member of FIG. 58.

FIGS. 56-58 illustrate a hinge assembly 160, which is an alternative embodiment of the hinge assembly 38. In the hinge assembly 160, the first hinge member 62 is replaced with a first hinge member 162, and the button and clutch assembly 98 is omitted. Because the button and clutch assembly 98 is omitted, the spline features 70, the ridge 71, and the circular aperture 68 are omitted from the first hinge member 162, reducing the complexity of the part. In the hinge assembly 160, the first hinge member 162 and the second hinge member 72 can rotate freely relative to one another. The hinge assembly 160 may be used with the hinge assembly 40 to support the shield 28. Because the hinge assembly 160 can rotate freely, the hinge assembly 160 may guide the shield 28 while permitting the hinge assembly 40 to perform all of the rotation control of the shield 28. This may facilitate operation of the station 10, as the entire shield 28 can be controlled using one button 100. This arrangement may be particularly advantageous in embodiments where the shield 28 is small and relatively light. In larger systems where the shield 28 is heavier, the hinge assembly 38 may be utilized to support the weight of the shield 28 evenly at both ends of the shield 28.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the food and/or beverage station as shown in the various exemplary embodiments is illustrative only. Additionally, any element disclosed in one embodiment may be incorporated or utilized with any other embodiment disclosed herein. For example, the hinge assembly 162 of the exemplary embodiment shown in at least FIG. 56 may be incorporated in the station 10 of the exemplary embodiment shown in at least FIG. 1. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A protective enclosure for a food protection system, the protective enclosure comprising:

a first hinge member coupled to one of a frame and a shield;

a second hinge member coupled to the other of the frame and the shield and rotatably coupled to the first hinge member; and a coupler selectively repositionable relative to the first hinge member between (a) an engaged position in which the coupler engages the first hinge member to limit rotation of the coupler relative to the first hinge member and (b) a disengaged position in which the coupler is free to rotate relative to the first hinge member, wherein the coupler is rotatably coupled to the second hinge member such that (a) rotation of the coupler relative to the second hinge member in a first rotational direction is limited and (b) the coupler is free to rotate relative to the second hinge member in a second rotational direction opposite the first rotational direction.

2. The protective enclosure of claim 1, wherein the first hinge member, the second hinge member, and the coupler are configured to rotate relative to one another about an axis, and wherein the engaged position is offset from the disengaged position along the axis.

3. The protective enclosure of claim 1, further comprising:

a post fixedly coupled to the second hinge member; and a sleeve slidably coupled to the post such that rotation of the sleeve relative to the post is limited, wherein the coupler is rotatably coupled to the sleeve such that (a) rotation of the coupler relative to the sleeve in the first rotational direction is limited and (b) the coupler is free to rotate relative to the sleeve in the second rotational direction.

4. The protective enclosure of claim 3, wherein the post defines a first facet and the sleeve defines a second facet, wherein the first facet is configured to translate relative to the second facet as the coupler is moved between the engaged position and the disengaged position, and wherein the first facet is configured to engage the second facet to limit rotation of the sleeve relative to the post.

5. The protective enclosure of claim 3, wherein the first hinge member defines a button aperture that receives the sleeve, and wherein the sleeve is configured to be pressed by a user to move the coupler toward the disengaged position.

6. The protective enclosure of claim 5, further comprising a biasing member extending between the post and the sleeve and configured to bias the coupler toward the engaged position.

7. The protective enclosure of claim 3, wherein the first hinge member includes a first spline feature and the second hinge member includes a second spline feature, wherein the first spline feature engages the second spline feature to limit rotation of the coupler relative to the first hinge member when the coupler is in the engaged position, and wherein the first spline feature is disengaged from the second spline feature when the coupler is in the disengaged position.

8. The protective enclosure of claim 1, further comprising:

a sleeve coupled to the second hinge member; and a clutch member extending between the sleeve and the coupler, wherein the clutch member is configured to engage both the sleeve and the coupler to limit rotation of the coupler relative to the sleeve when the coupler is rotated relative to the second hinge member in the first rotational direction.

9. The protective enclosure of claim 8, wherein the first hinge member, the second hinge member, and the coupler are configured to rotate relative to one another about an axis, wherein a pocket is defined by one of the coupler or the sleeve, wherein the clutch member extends into the pocket, and wherein the pocket is positioned such that the clutch member is offset from the axis.

10. The protective enclosure of claim 8, wherein a pocket is defined by one of the coupler or the sleeve, the pocket having a deep region and a shallow region; and wherein the clutch member is received within the pocket such that (a) the clutch member is configured to move toward the deep region of the pocket when the coupler is rotated in the first rotational direction relative to the second hinge member and (b) the clutch member is configured to move toward the shallow region of the pocket and limit rotation of the coupler in the second rotational direction.

11. The protective enclosure of claim 10, wherein an inner annular surface of the coupler defines a plurality of recesses, wherein the recesses are angularly offset from one another along the inner annular surface, and wherein each recess is configured to receive the clutch member to limit rotation of the coupler in the second rotational direction.

12. The protective enclosure of claim 11, wherein the clutch member is a spherical bearing member.

13. The protective enclosure of claim 10, further comprising a biasing member coupled to the to the clutch member and configured to bias the clutch member toward the shallow region of the pocket.

14. The protective enclosure of claim 1, further comprising a shield coupling assembly coupling the shield to at least one of the first hinge member and the second hinge member, the shield coupling assembly comprising:

an elongate connecting member having a first end and a second end, the elongate connecting member defining an annular groove positioned between the first end and the second end;

a clamping base defining a first pocket that receives the elongate connecting member;

a clamping pad coupled to the clamping base, the shield extending between the clamping base and the clamping pad; and a securement member coupled to the clamping base and extending into the annular groove to limit movement of the clamping base relative to the elongate connecting member.

15. The protective enclosure of claim 14, wherein the clamping base defines a second pocket intersecting the first pocket, wherein the second pocket receives the securement member such that the annular groove is at least partially contained within the first pocket.

16. The protective enclosure of claim 15, wherein the second pocket is threaded, and wherein both the securement member and the clamping pad are in threaded engagement with the second pocket.

17. A food protection system, comprising:

a food station configured to contain at least one of food products or beverages for serving;

a shield panel configured to obstruct access to the at least one of food products or beverages;

a frame coupled to the food station and supporting the shield panel; and a hinge assembly coupling the shield panel to the frame such that the shield panel is configured to be selectively raised relative to the food station, the hinge assembly comprising:

a first hinge member coupled to one of the frame and the shield panel;

a second hinge member coupled to the other of the frame and the shield panel;

a coupling ring coupled to the first hinge member and defining an aperture;

a post coupled to the second hinge member, extending along a post axis, and received by the aperture of the coupling ring; and a plurality of clutch members extending between the post and the coupling ring, the clutch members being movable relative to the post and the coupling ring, wherein the coupling ring is free to rotate relative to the post about the post axis in a first rotational direction corresponding to raising the shield panel, and wherein the clutch members are configured to engage the post and the coupling ring to inhibit rotation of the coupling ring relative to the post in a second rotational direction corresponding to lowering the shield panel.

18. The food protection system of claim 17, wherein a pocket is defined by one of the coupling ring or the post, the pocket having a deep region and a shallow region; and wherein a first clutch member of the plurality of clutch members is received within the pocket such that (a) the first clutch member is configured to move toward the deep region of the pocket when the coupling ring is rotated in the first rotational direction and (b) the first clutch member is configured to move toward the shallow region of the pocket to inhibit rotation of the coupling ring in the second rotational direction.

19. A food protection system, comprising:

a food station configured to contain at least one of food products or beverages for serving;

a shield panel configured to obstruct access to the at least one of food products or beverages;

a frame coupled to the food station and supporting the shield panel; and a hinge assembly coupling the shield panel to the frame such that the shield panel is configured to be selectively raised relative to the food station, the hinge assembly comprising:

a first hinge member coupled to one of the frame and the shield panel;

a second hinge member coupled to the other of the frame and the shield panel;

a coupling ring coupled to the first hinge member and defining an aperture;

a post coupled to the second hinge member, extending along a post axis, and received by the aperture of the coupling ring; and a plurality of clutch members extending between the post and the coupling ring, wherein the coupling ring is free to rotate relative to the post about the post axis in a first rotational direction corresponding to raising the shield panel, and wherein the clutch members are configured to engage the post and the coupling ring to inhibit rotation of the coupling ring relative to the post in a second rotational direction corresponding to lowering the shield panel;

wherein a pocket is defined by one of the coupling ring or the post, the pocket having a deep region and a shallow region; and wherein a first clutch member of the plurality of clutch members is received within the pocket such that (a) the first clutch member is configured to move toward the deep region of the pocket when the coupling ring is rotated in the first rotational direction and (b) the first clutch member is configured to move toward the shallow region of the pocket to inhibit rotation of the coupling ring in the second rotational direction.

* * * * *